US010829273B2

(12) United States Patent
Todaka et al.

(10) Patent No.: US 10,829,273 B2
(45) Date of Patent: Nov. 10, 2020

(54) BAG BODY PROVIDED WITH ZIPPER TAPE, BAG BODY, METHOD FOR PRODUCING BAG BODY, AND DEVICE FOR PRODUCING BAG BODY

(71) Applicant: IDEMITSU UNITECH CO., LTD., Tokyo (JP)

(72) Inventors: Takumi Todaka, Chiba (JP); Shunichi Ito, Chiba (JP)

(73) Assignee: IDEMITSU UNITECH CO., LTD., Tokyo (JP)

( * ) Notice: Subject to any disclaimer, the term of this patent is extended or adjusted under 35 U.S.C. 154(b) by 0 days.

(21) Appl. No.: 15/760,108

(22) PCT Filed: Sep. 13, 2016

(86) PCT No.: PCT/JP2016/076933
§ 371 (c)(1),
(2) Date: Mar. 14, 2018

(87) PCT Pub. No.: WO2017/047573
PCT Pub. Date: Mar. 23, 2017

(65) Prior Publication Data

US 2018/0251268 A1 Sep. 6, 2018

(30) Foreign Application Priority Data

Sep. 14, 2015 (JP) ..... 2015-181240

(51) Int. Cl.
*B65D 33/25* (2006.01)
*A44B 19/16* (2006.01)
(Continued)

(52) U.S. Cl.
CPC ..... *B65D 33/2533* (2013.01); *A44B 19/16* (2013.01); *B31B 70/8133* (2017.08);
(Continued)

(58) Field of Classification Search
CPC ..... B65D 33/2533; B65D 33/065; B65D 33/2583; B65D 33/08; A44B 19/16; B31B 70/8133
See application file for complete search history.

(56) References Cited

U.S. PATENT DOCUMENTS 4,046,257 A * 9/1977 Lehmacher ..... B29C 65/18 206/544
5,100,246 A 3/1992 La Pierre et al.
(Continued)

FOREIGN PATENT DOCUMENTS

CN 204150374 U 2/2015
EP 1364884 A1 11/2003
(Continued)

OTHER PUBLICATIONS

International Preliminary Report on Patentability dated Mar. 20, 2018.
(Continued)

*Primary Examiner* — Nathaniel C Chukwurah
*Assistant Examiner* — Lucas E. A. Palmer
(74) *Attorney, Agent, or Firm* — Millen, White, Zelano & Branigan, PC; Ryan Pool

(57) ABSTRACT

A male belt-shaped base having a male member with a short width, and a separation strip are heat-sealed to a film. A female belt-shaped base having a female member with a long width is heat-sealed at a predetermined position so that the male portion and the female portion are at engageable positions. The film is layered and suitably sealed to form a zipper-tape bag. The film and the separation strip are cut to form a cut portion at a non-bonded region in which the film of the zipper-tape bag is not bonded, thereby forming an unsealing tab. The unsealing tab can be easily formed by simply cutting the film.

4 Claims, 21 Drawing Sheets

(51) Int. Cl.

| | |
|---|---|
| ***B65D 33/06*** | (2006.01) |
| ***B31B 70/81*** | (2017.01) |
| ***B65D 33/08*** | (2006.01) |

(52) U.S. Cl.

CPC ..... *B65D 33/065* (2013.01); *B65D 33/08* (2013.01); *B65D 33/2583* (2013.01)

(56) References Cited

U.S. PATENT DOCUMENTS

| | | | | |
|---|---|---|---|---|
| 5,116,140 | A * | 5/1992 | Hirashima | B65D 75/66 383/206 |
| 5,461,845 | A * | 10/1995 | Yeager | B65B 61/188 383/203 |
| 5,601,368 | A * | 2/1997 | Bodolay | B65D 33/2533 383/203 |
| 5,806,984 | A * | 9/1998 | Yeager | B65D 33/2533 383/204 |
| 6,015,373 | A * | 1/2000 | Henderson | B31B 70/00 383/107 |
| 7,395,642 | B2 | 7/2008 | Plourde et al. | |
| 7,476,030 | B1 * | 1/2009 | Kuge | B65D 33/2533 383/203 |
| 7,597,480 | B2 * | 10/2009 | Kuge | B65D 31/10 383/120 |
| 8,066,434 | B2 * | 11/2011 | Nanba | B65D 33/2575 383/204 |
| 8,714,821 | B2 | 5/2014 | Nanba et al. | |
| 9,694,943 | B2 | 7/2017 | Shioda et al. | |
| 2001/0046334 | A1 * | 11/2001 | Yeager | B65D 33/2533 383/203 |
| 2002/0020481 | A1 * | 2/2002 | Bodolay | B65D 33/2533 156/66 |
| 2003/0215165 | A1 | 11/2003 | Hogan et al. | |
| 2005/0008268 | A1 | 1/2005 | Plourde et al. | |
| 2009/0238500 | A1 * | 9/2009 | Nanba | B65D 33/2533 383/203 |
| 2010/0002964 | A1 * | 1/2010 | Yeager | B65D 33/1691 383/204 |
| 2010/0266224 | A1 * | 10/2010 | Nanba | B65D 33/2533 383/204 |
| 2012/0085479 | A1 | 4/2012 | Goto | |
| 2012/0195526 | A1 * | 8/2012 | Moehlenbrock | B65D 33/20 383/42 |
| 2015/0183556 | A1 * | 7/2015 | Shioda | B65D 33/2508 383/63 |
| 2015/0353238 | A1 * | 12/2015 | Moehlenbrock | B65D 31/10 383/63 |

FOREIGN PATENT DOCUMENTS

| | | | |
|---|---|---|---|
| JP | H04253644 | A | 9/1992 |
| JP | H09207948 | A | 8/1997 |
| JP | 2003095286 | A | 4/2003 |
| JP | 2005205736 | A | 8/2005 |
| JP | 2005263300 | A | 9/2005 |
| JP | 2009113846 | A | 5/2009 |
| JP | 5651850 | B1 | 1/2015 |
| JP | 5651851 | B | 1/2015 |

OTHER PUBLICATIONS

English Translation of the Written Opinion of the International Search Authority for PCT/JP2016/076933 dated Feb. 7, 2018.
Partial Search Report issued for the corresponding European patent application No. 16846444.4 dated Feb. 18, 2019 (pp. 1-13).
International Search Report for PCT/JP2016/076933 dated Dec. 13, 2016.
English Abstract of JP-2003095286, Publication Date: Apr. 3, 2003.
English Abstract of JP2005205736, Publication Date: Aug. 4, 2005.
English Abstract of JP2005263300, Publication Date: Sep. 29, 2005.
English Abstract of JPH09207948, Publication Date: Aug. 12, 1997.
English Abstract of JP5651851, Publication Date: Jan. 14, 2015.
Office Action in corresponding Taiwanese patent application 105129890 dated Aug. 27, 2019 (pp. 1-14).

* cited by examiner

BAG BODY PROVIDED WITH ZIPPER TAPE, BAG BODY, METHOD FOR PRODUCING BAG BODY, AND DEVICE FOR PRODUCING BAG BODY

TECHNICAL FIELD

The present invention relates to a zipper-tape bag, a bag body, a manufacturing method of a bag, and a manufacturing machine of a bag.

BACKGROUND ART

Zipper-tape bags re-sealable after once unsealing bag bodies that house contents have recently come to be widely used. Some of examples of the zipper-tape bags each include an unsealing tape for tearing the bag body to unseal the bag (see, for instance, Patent Literatures 1, 2).

The zipper-tape bags disclosed in Patent Literatures 1, 2 are each provided with a male member and a female member each including a belt-shaped base, a layered portion that is provided on one of the belt-shaped bases of the male member and the female member and is thinner than an adjacent portion, and an unsealing tape layered on the layered portion. A projection is provided on the other of the belt-shaped bases at an end near an opening of a bag body in a width direction, the projection having a height equal to or larger than the thickness of the layered portion and being bonded to an inner surface of the bag. The bags further each include a cut, which penetrates through the bag body and the one of the belt-shaped bases provided with the layered portion, to form a tab.

To unseal the bag, the tab is pinched to simultaneously cut off the unsealing tape and the layered portion from the belt-shaped base and tear the bag body.

CITATION LIST

Patent Literatures

Patent Literature 1 JP-5651850 B1
Patent Literature 2 JP-5651851 B1

SUMMARY OF THE INVENTION

Problems to Be Solved By the Invention

After dedicated studies, the inventors have found an easily openable zipper-tape bag including a separation strip, a bag, a manufacturing method of a bag, and a manufacturing machine of a bag.

An object of the invention is to provide an easily openable zipper-tape bag including a separation strip, a bag, a manufacturing method of a bag, and a manufacturing machine of a bag.

Means for Solving the Problems

A method according to an aspect of the invention is for manufacturing a bag including: a bag body including a folded single film or at least two sheets of film layered on each other; a zipper tape attached to one of opposing inner surfaces of the bag body; and a longitudinal separation strip configured to form an opening in the bag body, in which the zipper tape includes a female member including a female belt-shaped base and a female portion provided on the female belt-shaped base, a male member including a male belt-shaped base and a male portion provided on the male belt-shaped base and engageable with the female portion, and an extension on one of the female belt-shaped base and the male belt-shaped base, the extension being defined, when the female portion and the male portion are engaged, by a part of a longer-width one of the female belt-shaped base and the male belt-shaped base lengthened toward an end in a width direction with respect to a shorter-width one of the female belt-shaped base and the male belt-shaped base, and the separation strip is interposed between the female belt-shaped base and the male belt-shaped base or between the longer-width one of the female belt-shaped base and the male belt-shaped base and the film on which the shorter-width one of the female belt-shaped base and the male belt-shaped base is attached, the separation strip being a longitudinal component configured to cut the film attached with the shorter-width one of the female belt-shaped base and the male belt-shaped base to form the opening in the bag body, the separation strip being disposed at a position facing the extension, the method including: attaching the separation strip and the shorter-width one of the female belt-shaped base and the male belt-shaped base on the film separately or attaching the separation strip having been integrated with the shorter-width one of the female belt-shaped base and the male belt-shaped base on the film; attaching the longer-width one of the female belt-shaped base and the male belt-shaped base on the film attached with the separation strip and the shorter-width one of the female belt-shaped base and the male belt-shaped base in a manner capable for the female portion and the male portion to be engaged; and cutting the separation strip and the film attached with the shorter-width one of the female belt-shaped base and the male belt-shaped base to form a tab without cutting the film facing a surface of the longer-width one of the female belt-shaped base and the male belt-shaped base opposite a surface provided with the female portion or the male portion of the longer-width one of the female belt-shaped base and the male belt-shaped base while a facing portion defined at a part of the longer-width one of the female belt-shaped base and the male belt-shaped base, which faces the separation strip, is not bonded with the separation strip.

It should be noted that the manufacturing method of the bag according to the above aspect of the invention is suitable as a manufacturing method of various bags including a bag produced by folding a single sheet of film, a bag produced by layering two sheets of film, and a gusset bag and a self-standing bag including two or more sheets of film to provide gussets at lateral sides thereof.

According to the above aspect of the invention, the facing portion, which is at the part of the longer-width one of the female belt-shaped base and the male belt-shaped base facing the separation strip, is not bonded to the separation strip. The tab, which is pinched when the film is torn to unseal the bag, is formed in the non-bonded region by cutting the separation strip and the film attached with the shorter-width one of the female belt-shaped base and the male belt-shaped base without cutting the film facing the surface of the longer-width one of the female belt-shaped base and the male belt-shaped base opposite the surface provided with the female portion or the male portion. Accordingly, the tab can be formed by cutting the separation strip and the film attached with the separation strip. Since the separation strip and the facing portion are not bonded in the bag manufactured according to the manufacturing method of the above aspect of the invention, the separation strip can be easily separated from the facing portion when the tab is pinched to pull the separation strip, so that it is expected that the bag can be smoothly unsealed.

The tab may be suitably formed using any means (e.g. a laser device and a blade) capable of cutting the film. Incidentally, the cutting depth may be adjusted in forming the tab. The tab may be configured in any shape as long as the separation strip can be pinched by fingers. For instance, the tab may be C-shaped.

The shape of the separation strip is not limited as long as the bag body can be torn. For instance, the separation strip may be suitably a belt-shaped component or a string-shaped component.

The separation strip may be directly attached to the film. Alternatively, the separation strip may be integrated with a part of the belt-shaped base and the separation strip may be attached to the film through the part of the belt-shaped base.

Further, in the non-bonded state, the longer-width one of the female belt-shaped base and the male belt-shaped base is not necessarily separated from the separation strip but may be in contact with the separation strip as long as being not bonded.

In the above arrangement, a first convex portion thicker than a thickness of the shorter-width one of the female belt-shaped base and the male belt-shaped base may be provided to the shorter-width one of the female belt-shaped base and the male belt-shaped base at a side adjacent to the separation strip at the end in the width direction, and a second convex portion thicker than the longer-width one of the thickness of the female belt-shaped base and the male belt-shaped base may be provided to the longer-width one of the female belt-shaped base and the male belt-shaped base at a side adjacent to the separation strip at an end in the width direction.

In the above arrangement, the first convex portion and the second convex portion may be positioned at ends of the separation strip in the width direction. According to the above arrangement, when the bag body is torn to unseal the bag using the separation strip, the first convex portion and the second convex portion serve as guides for tearing the bag body, thereby preventing the bag body from being torn in an unintended direction. Further, the first convex portion and the second convex portion are located close to the opening edges of the bag body. According to the above arrangement, when the opening edges of the bag body are widely separated to disengage the male portion and the female portion, the first convex portion and the second convex portion serve as slip stoppers, thereby facilitating the opening process of the bag body.

A method according to another aspect of the invention is for manufacturing a bag including: a bag body including a folded single film or at least two sheets of film layered on each other; a zipper tape attached to one of opposing inner surfaces of the bag body; and a longitudinal separation strip configured to form an opening in the bag body, in which the zipper tape includes a male portion and a female portion that are engageable with each other, and a belt-shaped portion on which the male portion and the female portion are provided at different positions, the belt-shaped portion being folded to define a folded portion so that the male portion and the female portion are engageable, and the separation strip is a longitudinal component located between the female portion and the male portion on the belt-shaped portion of the zipper tape at a position near the female portion or the male portion with respect to the folded portion, the separation strip being configured to cut the film to form an opening in the bag body, the method including: attaching the zipper tape onto the film; and cutting the film attached with the zipper tape at a part corresponding to the separation strip of the zipper tape attached to the film to form a tab without cutting the film facing a surface of the folded belt-shaped portion opposite a surface facing the separation strip while a facing portion defined at a part of the folded belt-shaped portion facing the separation strip is not bonded with the separation strip.

According to the above aspect of the invention, the facing portion, which is the part of the folded belt-shaped portion facing the separation strip, is not bonded to the separation strip. Further, the tab, which is pinched when the film is torn by the separation strip to unseal the bag, is formed by cutting the film attached with the separation strip in the non-bonded region. Accordingly, the tab can be formed by cutting the film attached with the separation strip. Since the separation strip and the facing portion are not bonded in the bag manufactured according to the manufacturing method of the above aspect of the invention, the separation strip can be easily separated from the facing portion when the tab is pinched to pull the separation strip, so that it is expected that the bag can be smoothly unsealed.

The tab is formed by cutting the separation strip and the surface torn by the separation strip without cutting the surface of the bag facing the surface torn by the separation strip. The tab may be configured in any shape as long as the separation strip can be pinched by fingers. For instance, the tab may be C-shaped.

In the above aspect of the invention, the zipper tape may include a first convex portion and a second convex portion each having a thickness larger than a thickness of the belt-shaped portion, the first convex portion and the second convex portion being located on the belt-shaped portion near respective ends of the separation strip in the width direction.

In the above arrangement, the first convex portion and the second convex portion are positioned at ends of the separation strip in the width direction. According to the above arrangement, when the bag body is torn to unseal the bag using the separation strip, the first convex portion and the second convex portion serve as guides for tearing the bag body, thereby preventing the bag body from being torn in an unintended direction. Further, the first convex portion and the second convex portion are located close to the opening edges of the bag body. According to the above arrangement, when the opening edges of the bag body are widely separated to disengage the male portion and the female portion, the first convex portion and the second convex portion serve as slip stoppers, thereby facilitating the unsealing process of the bag body.

In the above arrangement, a clearance may be provided between the separation strip and the first convex portion and between the separation strip and the second convex portion.

According to the above arrangement, since the clearance is provided between the separation strip and the first convex portion and between the separation strip and the second convex portion, when, for instance, the zipper tape is fused to the film and molten resin spreads sideways, the clearance prevents the separation strip from being integrated with the female member and the male member. Thus, the separation strip can be easily separated from the bag body, so that the bag body can be easily cut by the separation strip.

In the above aspect of the invention, the separation strip may be attached to the film in a form of a component independent of the zipper tape.

According to the above arrangement, when the separation strip is attached to the film separately from the zipper tape or the separation strip having been integrated with the zipper tape is attached to the film after being separated from the zipper tape, the bag body is torn to unseal the bag only with a force for tearing the bag body without the necessity of a force for separating the separation strip from the zipper tape, so that a large load is not applied in unsealing the bag. In particular, when the separation strip having been integrated with the zipper tape is separated from the zipper tape immediately before being attached to the film, even if a tension causing different degree of stretch is applied during the production process, the female member, the male member and the separation strip can be appropriately positioned and attached at predetermined positions before being stretched. Thus, the female member, the male member and the separation strip are kept from being stretched at different rates, so that the female member, the male member and the separation strip can be attached to the film without being wrinkled or the like, thereby preventing deterioration in the yield rate and achieving favorable production.

Herein, in attaching the separation strip having been integrated with the zipper tape to the film after being separated from the zipper tape, the separation strip may be attached to the film at the same time as being separated from the zipper tape. Further, when the separation strip is separated, the separation strip is not necessarily cut. The separation of the separation strip may be exemplarily achieved not by cutting, but by providing a perforated portion in a form of a dashed cut line like a perforation or a thin portion thinner than the other parts between the shorter-width one of the male belt-shaped base and the female belt-shaped base and the separation strip and tearing the zipper tape at the perforated portion or the thin portion, or by an interfacial separation at a boundary between the male/female belt-shaped base and the tearing guide piece.

A method according to still another aspect of the invention is for manufacturing a bag including a bag body including a folded single film or at least two sheets of film layered on each other, and a tape bonded to one of inner surfaces of the bag body, in which the tape includes at least one elongated base, a longitudinal separation strip bonded to the base along a longitudinal direction of the base and configured to tear the base and the film, and at least one protrusion located on a surface of a part of the base at which the separation strip is not bonded, the protrusion protruding in a direction normal to the base in which the separation strip is protruded, the method including: attaching the base to the film defining the one of inner surfaces of the bag body separately from the separation strip or with the separation strip having been integrated with the base; and cutting the tape and the film attached with the base to form a tab without cutting the film facing the film attached with the base while the tape is not bonded to a facing portion defined at a part of the film facing the film attached with the base and facing the tape.

According to the above aspect of the invention, the facing portion, which is defined at the part of the film facing the tape, is not bonded to the tape. The tab, which is pinched when the film is torn by the separation strip to unseal the bag, is formed by cutting the film attached with the base and the tape without cutting the film facing the film attached with the base in the non-bonded region. Thus, the tab can be formed by cutting the tape and the film attached with the base. Since the tape and the facing portion are not bonded in the bag manufactured according to the manufacturing method of the above aspect of the invention, the separation strip can be easily separated from the facing portion when the tab is pinched to pull the separation strip, so that it is expected that the bag can be smoothly unsealed.

The tab may be suitably formed using any means (e.g. a laser device and a blade) capable of cutting the film, as in the above-described manufacturing method of the zipper-tape bag.

The separation strip, which has been provided on the base in advance, is provided on the film. The separation strip is not necessarily heat-sealed, but various methods such as welding by ultrasonic waves and bonding using an adhesive or the like are applicable in order to attach the separation strip.

When the tape is not bonded to the film, the tape is not necessarily separated from the film facing the film bonded with the base, but the tape may be in contact with the film as long as the tape is not bonded to the facing film.

The shape of the separation strip is not limited as long as the film and the base can be torn. For instance, the separation strip may be suitably a belt-shaped component or a string-shaped component.

In the above arrangement, the formation of the tab may include forming a non-bonded region at which the separation strip and/or the tape is not bonded to the facing portion.

According to the above arrangement, in order to form the non-bonded region in which the separation strip and/or the tape is not bonded to the facing portion, the separation strip and/or the tape and the facing portion around the non-bonded region are bonded using a bonding unit such as a seal bar. In the non-bonded region, the separation strip and/or the tape and the facing portion are not subjected to bonding using the seal bar or the like (i.e. not bonded).

According to the above arrangement, non-bonded region can be expected to be easily formed by not using the bonding unit such as the seal bar. Thus, the non-bonded region can be reliably formed, so that the bag can be easily unsealed using the separation strip.

A zipper-tape bag according to a further aspect of the invention includes: a bag body including a folded single film or at least two sheets of film layered on each other; a zipper tape attached to one of opposing inner surfaces of the bag body; and a longitudinal separation strip configured to form an opening in the bag body, in which the zipper tape includes: a female member including a female belt-shaped base and a female portion provided on the female belt-shaped base; a male member including a male belt-shaped base and a male portion provided on the male belt-shaped base and engageable with the female portion; and an extension on one of the female belt-shaped base and the male belt-shaped base, the extension being defined by a lengthened part of a longer-width one of the female belt-shaped base and the male belt-shaped base relative to a shorter-width one of the female belt-shaped base and the male belt-shaped base toward an end in the width direction with the female portion and the male portion being engaged, the separation strip is interposed between the female belt-shaped base and the male belt-shaped base or between the longer-width one of the female belt-shaped base and the male belt-shaped base and the film on which the shorter-width one of the female belt-shaped base and the male belt-shaped base is attached, the separation strip being a longitudinal component configured to cut the film attached with the shorter-width one of the female belt-shaped base and the male belt-shaped base to form the opening in the bag body, the separation strip being disposed at a position facing the extension, the separation strip and the shorter-width one of the female belt-shaped base and the male belt-shaped base are separately attached on the film or the separation strip having been integrated with the shorter-width one of the female belt-shaped base and the male belt-shaped base is attached on the film, the longer-width one of the female belt-shaped base and the male belt-shaped base is attached on the film attached with the separation strip and the shorter-width one of the female belt-shaped base and the male belt-shaped base in a manner capable for the female portion and the male portion to be engaged, the film facing a surface of the longer-width one of the female belt-shaped base and the male belt-shaped base opposite a surface on which the female portion or the male portion is provided is not cut, the zipper-tape bag further includes a tab formed by cutting the separation strip and the film on which the shorter-width one of the female belt-shaped base and the male belt-shaped base is attached, and the longer-width one of the female belt-shaped base and the male belt-shaped base is not bonded to the film facing the surface of the longer-width one of the female belt-shaped base and the male belt-shaped base opposite the surface on which the female portion or the male portion is provided.

According to the above aspect of the invention, the separation strip is not bonded to the longer-width one of the female belt-shaped base and the male belt-shaped base. The tab to be pinched when the film is torn by the separation strip to unseal the bag is provided in the non-bonded region.

Accordingly, the tab can be easily formed by a simply cutting the film attached with the longer-width one of the female member and the male member, thereby improving the productivity.

It should be noted that the bag body of the zipper-tape bag of the above aspect may include a grip at an end opposite the part containing the content across a part provided with the male member and/or the female member.

According to the above arrangement, the grip for holding the bag body allows the zipper-tape bag containing a heavy content to be held without the fear of dropping the zipper-tape bag.

In the above arrangement, a first convex portion thicker than a thickness of the shorter-width one of the female belt-shaped base and the male belt-shaped base may be provided to the shorter-width one of the female belt-shaped base and the male belt-shaped base at a side adjacent to the separation strip at an end in the width direction, and a second convex portion thicker than the thickness of the longer-width one of the female belt-shaped base and the male belt-shaped base may be provided to the longer-width one of the female belt-shaped base and the male belt-shaped base at a side adjacent to the separation strip at an end in the width direction.

In the above arrangement, the first convex portion and the second convex portion may be positioned at ends of the separation strip in the width direction. According to the above arrangement, when the bag body is torn to unseal the bag using the separation strip, the first convex portion and the second convex portion serve as guides for tearing the bag body, thereby preventing the bag body from being torn in an unintended direction. Further, the first convex portion and the second convex portion are located close to the opening edges of the bag body. According to the above arrangement, when the opening edges of the bag body are widely separated to disengage the male portion and the female portion, the first convex portion and the second convex portion serve as slip stoppers, thereby facilitating the unsealing process of the bag body.

A zipper-tape bag according to still further aspect of the invention includes: a bag body including a folded single film or at least two films layered on each other; a zipper tape attached to one of opposing inner surfaces of the bag body; and a longitudinal separation strip configured to form an opening in the bag body, in which the zipper tape includes a male portion and a female portion that are engageable with each other, and a belt-shaped portion on which the male portion and the female portion are provided at different positions, the belt-shaped portion being folded to define a folded portion so that the male portion and the female portion are engageable, the separation strip is a longitudinal component located between the female portion and the male portion on the belt-shaped portion of the zipper tape, the separation strip being configured to cut the film to form the opening in the bag body, the zipper-tape bag further includes a tab formed by cutting the separation strip and the film attached with the zipper tape at a part corresponding to the separation strip of the zipper tape attached to the film without cutting the film facing a surface of the folded belt-shaped portion opposite a surface facing the separation strip while the folded belt-shaped portion is not bonded with the separation strip, and the surface of the belt-shaped portion opposite the surface facing the separation strip is not bonded to the film facing the surface.

According to the above aspect of the invention, the separation strip is not bonded to the folded belt-shaped portion of the zipper tape facing the separation strip. Further, the tab to be pinched when the film is torn by the separation strip to unseal the bag is formed by cutting the film attached with the separation strip in the non-bonded region. Accordingly, the tab can be formed by cutting the film attached with the separation strip.

In the above arrangement, the zipper tape may include a first convex portion and a second convex portion each having a thickness larger than a thickness of the belt-shaped portion, the first convex portion and the second convex portion being located on the belt-shaped portion near respective ends of the separation strip in the width direction.

In the above arrangement, the first convex portion and the second convex portion are positioned at ends of the separation strip in the width direction. According to the above arrangement, when the bag body is torn to unseal the bag using the separation strip, the first convex portion and the second convex portion serve as guides for tearing the bag body, thereby preventing the bag body from being torn in an unintended direction. Further, the first convex portion and the second convex portion are located close to the opening edges of the bag body. According to the above arrangement, when the opening edges of the bag body are widely separated to disengage the male portion and the female portion, the first convex portion and the second convex portion serve as slip stoppers, thereby facilitating the unsealing process of the bag body.

In the above arrangement, a clearance may be provided between the separation strip and the first convex portion and between the separation strip and the second convex portion.

According to the above arrangement, since the clearance is provided between the separation strip and the first convex portion and between the separation strip and the second convex portion, when, for instance, the zipper tape is fused to the film and molten resin spreads sideways, the clearance prevents the separation strip from being integrated with the female member and the male member. Thus, the separation strip can be easily separated from the bag body, so that the bag body can be easily cut by the separation strip.

In the above arrangement, the separation strip may be attached to the film in a form of a component independent of the zipper tape.

According to the above arrangement, since the separation strip has been separated in advance from the zipper tape before the separation strip tears the bag body to unseal the bag, no force for separating the separation strip from the zipper tape is necessary but only a force for tearing the bag body is necessary in order to unseal the bag, so that a large load is not applied in unsealing the bag. In particular, when the separation strip is integrated with the zipper tape and the separation strip is separated from the zipper tape immediately before being attached to the film, even if a tension causing different degree of stretch is applied during the production process, the female member, the male member and the separation strip can be appropriately positioned and attached at predetermined positions before being stretched. Thus, the female member, the male member and the separation strip are kept from being stretched at different rates, so that the female member, the male member and the separation strip can be attached to the film without being wrinkled or the like, thereby preventing deterioration in the yield rate and achieving favorable production.

A bag according to still further aspect of the invention includes: a bag body including a folded single film or at least two sheets of film layered on each other; and a tape bonded to one of inner surfaces of the bag body, in which the tape includes at least one elongated base; a longitudinal separation strip bonded to the base along a longitudinal direction of the base and configured to tear the base and the film; and at least one protrusion located on a surface of a part of the base at which the separation strip is not bonded, the protrusion protruding in a direction normal to the base in which the separation strip is protruded, the base is attached to the film defining the one of inner surfaces of the bag body separately from the separation strip or with the separation strip having been integrated with the base, and the bag further includes a tab formed by cutting the tape and the film attached with the base without cutting the film facing the film attached with the base while the tape is not bonded to the film facing the film attached with the base.

According to the above aspect of the invention, the tape is not bonded to the film facing the film bonded with the base. The tab to be pinched when the base and the film are torn by the separation strip to unseal the bag is provided in the non-bonded region.

Accordingly, the bag capable of easily forming the tab can be provided by simply piercing the film attached with the tape.

A manufacturing machine according to still further aspect of the invention is for manufacturing a bag including: a bag body including a folded single film or at least two films layered on each other; a zipper tape attached to one of opposing inner surfaces of the bag body; and a longitudinal separation strip configured to form an opening in the bag body, in which the zipper tape includes: a female member including a female belt-shaped base and a female portion provided on the female belt-shaped base; a male member including a male belt-shaped base and a male portion provided on the male belt-shaped base and engageable with the female portion; and an extension on one of the female belt-shaped base and the male belt-shaped base, the extension being defined by a lengthened part of a longer-width one of the female belt-shaped base and the male belt-shaped base relative to a shorter-width one of the female belt-shaped base and the male belt-shaped base toward an end in the width direction with the female portion and the male portion being engaged, and the separation strip is interposed between the female belt-shaped base and the male belt-shaped base or between the longer-width one of the female belt-shaped base and the male belt-shaped base and the film on which the shorter-width one of the female belt-shaped base and the male belt-shaped base is attached, the separation strip being a longitudinal component configured to cut the film attached with the shorter-width one of the female belt-shaped base and the male belt-shaped base to form the opening in the bag body, the separation strip being disposed at a position facing the extension, the manufacturing machine including: a mechanism configured to attach the separation strip and the shorter-width one of the female belt-shaped base and the male belt-shaped base on the film separately or with the separation strip being integrated in advance with the shorter-width one of the female belt-shaped base and the male belt-shaped base; a mechanism configured to attach the longer-width one of the female belt-shaped base and the male belt-shaped base on the film attached with the separation strip and the shorter-width one of the female belt-shaped base and the male belt-shaped base in a manner capable for the female portion and the male portion to be engaged; and a mechanism configured to cut the separation strip and the film attached with the shorter-width one of the female belt-shaped base and the male belt-shaped base to form a tab without cutting the film facing a surface of the longer-width one of the female belt-shaped base and the male belt-shaped base opposite a surface provided with the female portion or the male portion of the longer-width one of the female belt-shaped base and the male belt-shaped base while a facing portion defined at a part of the longer-width one of the female belt-shaped base and the male belt-shaped base, which faces the separation strip, is not bonded with the separation strip.

According to the above aspect of the invention, the facing portion, which is defined at the part of the longer-width one of the female belt-shaped base and the male belt-shaped base, and faces the separation strip, is not bonded to the separation strip by the mechanism for forming the tab. The tab to be pinched when the film is torn to unseal the bag using the separation strip is formed in the non-bonded region by cutting the separation strip and the film attached with the shorter-width one of the female belt-shaped base and the male belt-shaped base without cutting the film facing the surface of the longer-width one of the female belt-shaped base and the male belt-shaped base opposite the surface provided with the female portion or the male portion. Accordingly, the tab can be formed by cutting the separation strip and the film attached with the separation strip. Since the separation strip and the facing portion are not bonded in the bag manufactured using the manufacturing machine of the above aspect of the invention, the separation strip can be easily separated from the facing portion when the tab is pinched to pull the separation strip, so that it is expected that the bag can be smoothly unsealed.

A manufacturing machine according to still further aspect of the invention is for manufacturing a bag including: a bag body including a folded single film or at least two films layered on each other; a zipper tape attached to one of opposing inner surfaces of the bag body; and a longitudinal separation strip for forming an opening in the bag body, in which the zipper tape includes a male portion and a female portion that are engageable with each other, and a belt-shaped portion on which the male portion and the female portion are provided at different positions, the belt-shaped portion being folded to define a folded portion so that the male portion and the female portion are engageable, and the separation strip is a longitudinal component located between the female portion and the male portion on the belt-shaped portion of the zipper tape at a position near the female portion or the male portion with respect to the folded portion, the separation strip being configured to cut the film to form the opening in the bag body, the manufacturing machine including: a mechanism configured to attach the zipper tape to the film; and a mechanism configured to cut the film attached with the zipper tape at a part corresponding to the separation strip of the zipper tape attached to the film to form a tab without cutting the film facing a surface of the folded belt-shaped portion opposite a surface facing the separation strip while a facing portion defined at a part of the folded belt-shaped portion facing the separation strip is not bonded with the separation strip.

According to the above aspect of the invention, the facing portion, which is defined at the part of the folded belt-shaped portion facing the separation strip, is not bonded to the separation strip by the mechanism for forming the tab. Further, the tab to be pinched when the film is torn by the separation strip to unseal the bag is formed by cutting the film attached with the separation strip in the non-bonded region. Accordingly, the tab can be formed by cutting the film attached with the separation strip. Since the separation strip and the facing portion are not bonded in the bag manufactured using the manufacturing machine of the above aspect of the invention, the separation strip can be easily separated from the facing portion when the tab is pinched to pull the separation strip, so that it is expected that the bag can be smoothly unsealed.

A manufacturing machine according to still further aspect of the invention is for manufacturing a bag including: a bag body including a folded single film or at least two sheets of film layered on each other; and a tape bonded to one of inner surfaces of the bag body, in which the tape includes: at least one elongated base; a longitudinal separation strip bonded to the base along a longitudinal direction of the base and configured to tear the base and the film; and at least one protrusion located on a surface of a part of the base at which the separation strip is not bonded, the protrusion protruding in a direction normal to the base in which the separation strip is protruded, the manufacturing machine including: a mechanism configured to attach the base to the film defining the one of inner surfaces of the bag body separately from the separation strip or with the separation strip having been integrated with the base; and a mechanism configured to cut the tape and the film attached with the base to form a tab without cutting the film facing the film attached with the base while the tape is not bonded to a facing portion defined at a part of the film facing the film attached with the base and facing the tape.

According to the above aspect of the invention, the mechanism for forming the tab allows the tape not to be bonded with the part of the film facing the film bonded with the base. Further, the tab, which is to be pinched when the base and the film are torn by the separation strip to unseal the bag, is formed without cutting the part of the film facing the film attached with the base in the non-bonded region. Thus, the manufacturing machine capable of easily forming the tab by cutting the film bonded with the base, the base and the separation strip can be provided.

In addition, since the separation strip and the not-to-be-torn film facing the film to be torn are not bonded in the bag manufactured using the manufacturing machine of the above aspect of the invention, the separation strip can be kept from being bonded to the not-to-be-torn film when the tab is pinched to pull the separation strip, so that it is expected that the bag can be smoothly unsealed.

In the above aspect of the invention, the mechanism configured to form the tab may include a mechanism configured to form a non-bonded region at which the separation strip and/or the tape is not bonded to the facing portion.

According to the above arrangement, in order to form the non-bonded region in which the separation strip and/or the tape is not bonded to the facing portion, the part around the non-bonded region is bonded using a bonding unit such as a seal bar. In the above arrangement, the non-bonded region is not subjected to the bonding process using the seal bar or the like.

According to the above arrangement, the non-bonded region can be expected to be easily formed by not using the bonding unit such as the seal bar. Thus, the non-bonded region can be reliably formed, so that the bag can be easily unsealed using the separation strip.

In the above aspect of the invention, the mechanism configured to form the tab may include a blade and a movement restrictor configured to restrict a movement of the blade.

According to the above arrangement, the movement restrictor can adjust the displacement of the blade to achieve a so-called half-cut where the film bonded with the separation strip is cut without cutting the film not bonded with the zipper tape. Accordingly, the half-cut can be easily achieved irrespective of the thickness and/or material of the film and the zipper tape.

The movement restrictor may exemplarily be a device using an elastic force of an elastic component (e.g. a rubber, foamed resin and spring), a device configured to read a value of a pressure applied to the blade by a driver and stop applying the pressure on the blade when the pressure reaches a predetermined level, or a spacer configured to restrict the displacement of the blade.

DESCRIPTION OF EMBODIMENT(S)

Figure 1:
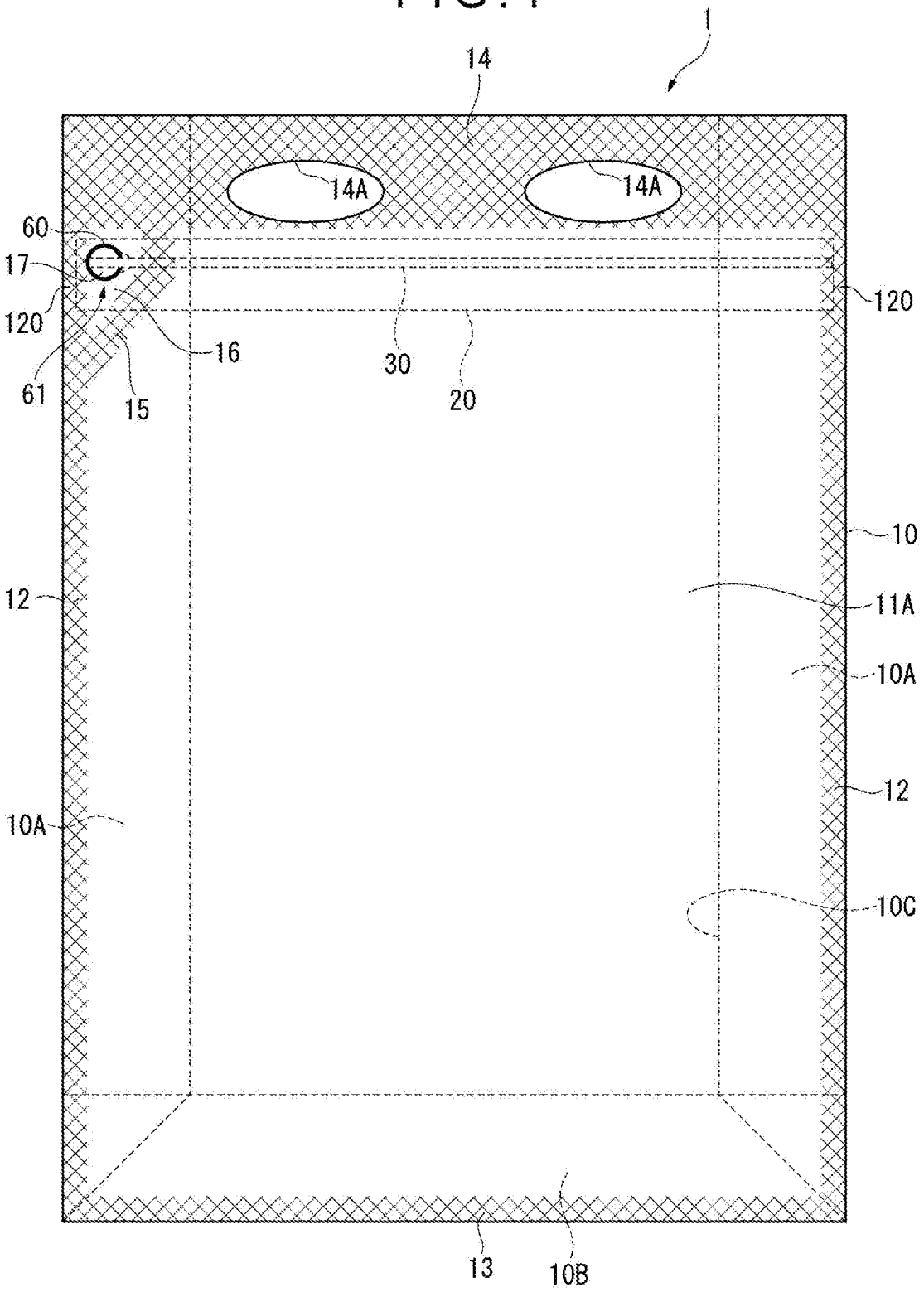
FIG. 1 is a front elevational view showing a zipper-tape bag according to a first exemplary embodiment of the invention.

An exemplary embodiment of the invention will be described below with reference to the attached drawings.

In the description of the exemplary embodiments, common reference numerals will be given to the same components to simplify or omit their explanations. It should be understood that the scope of the zipper tape and the zipper-tape bag of the invention is by no means limited by the disclosure in the exemplary embodiments below.

First Exemplary Embodiment

FIGS. 1 to 3B show a zipper-tape bag according to a first exemplary embodiment.

Though a zipper tape bag in the first exemplary embodiment is exemplarily provided in a form of a bag for packaging various articles including food, medicine, medical products, stationeries, and miscellaneous goods, the use of the zipper bag is not limited to packaging these examples of the articles.

Structure of Zipper-Tape Bag

FIG. 1 shows a front elevation of a zipper-tape bag 1.

As shown in FIG. 1, the zipper-tape bag 1 includes: a bag body 10 having a rectangular profile in a plan view and configured to receive a content; a zipper tape 20 that is bonded (e.g. heat-sealed) to an inner surface of the bag body 10; and a tearing guide piece 30 (separation strip). A tape 2 in the first exemplary embodiment includes the zipper tape 20 and the tearing guide piece 30.

Structure of Bag Body

The bag body 10 includes: layered films 11A, 11B (only the film 11A is shown in FIG. 1); and a pair of opposing lateral portions 10A provided at both ends of the layered films 11A, 11B, the lateral portions 10A each being in a form of a gusset interfolded along a bend line. Further, the bag body 10 includes a bottom portion 10B at a bottom part of the layered films interfolded along a bend line.

The bag body 10 includes pairs of side seals 12 at layered portions of the films 11A, 11B and the lateral portions 10A. A bottom seal is formed at a bottom end of the bag body 10 at which the films 11A, 11B are layered on the bottom portion 10B. A top seal 14 is formed at an end of the layered films 11A, 11B orthogonal to the side seals 12 and opposite the bottom seal 13.

Further, the bag body 10 includes a partition seal 15 near one of the side seals 12 (left one of the side seals 12 in FIG. 1). The partition seal 15, the side seals 12 and the top seal 14 define a non-bonded region 16 thereinside.

Further, a housing space 10C, in which a content P (see FIG. 9) is to be received, is defined in the bag body 10 by the side seals 12, the bottom seal 13, the top seal 14, and the partition seal 15.

The zipper tape 20 and the tearing guide piece 30 are attached to one of the films (the film 11A) of the bag body 10.

Flattened point seals 120 are formed at both longitudinal ends of the zipper tape 20 and the tearing guide piece 30 overlapped with the side seals 12 of the bag body 10.

Two grips 14A defined by holes are formed in the top seal 14.

The grips 14A are holes that are oblong in a plan view and formed in the films 11A, 11B.

It should be noted that the shape of the holes are not necessarily oblong in a plan view but may alternatively be circular, rectangular, triangular or the like in a plan view. Further, the number of the holes is not limited but at least one is necessary to comfortably hold the bag. Further, the grip 14A may be provided in various forms. For instance, a separate string member may be attached in order to hold the bag. It should also be noted that the grip is not necessarily provided.

The films 11A, 11B may be single-layered or multi-layered films formed of, for instance, a thermoplastic resin such as (linear) low-density polyethylene (LLDPE), and polypropylene (PP). Examples of a surface base material usable for the multi-layered films include a biaxially-oriented polypropylene (Oriented Polypropylene: OPP), biaxially-oriented polyethylene terephthalate (OPET), biaxially-oriented nylon (ONy), and cast polypropylene (CPP). The multi-layered film may include an inorganic layer formed by depositing aluminum, laminating an aluminum foil, and the like in order to block light and permeation of gas (gas barrier).

Though any material for packaging bag is usable for the films 11A, 11B, it is preferable that the thickness of the films 11A, 11B is 10 μm or more and 200 μm or less. When the thickness is less than 10 μm, sealing strength and bag strength may sometimes be lowered. In contrast, the thickness exceeding 200 μm may sometimes make it difficult to unseal the bag.

Structure of Zipper Tape

Figure 2:
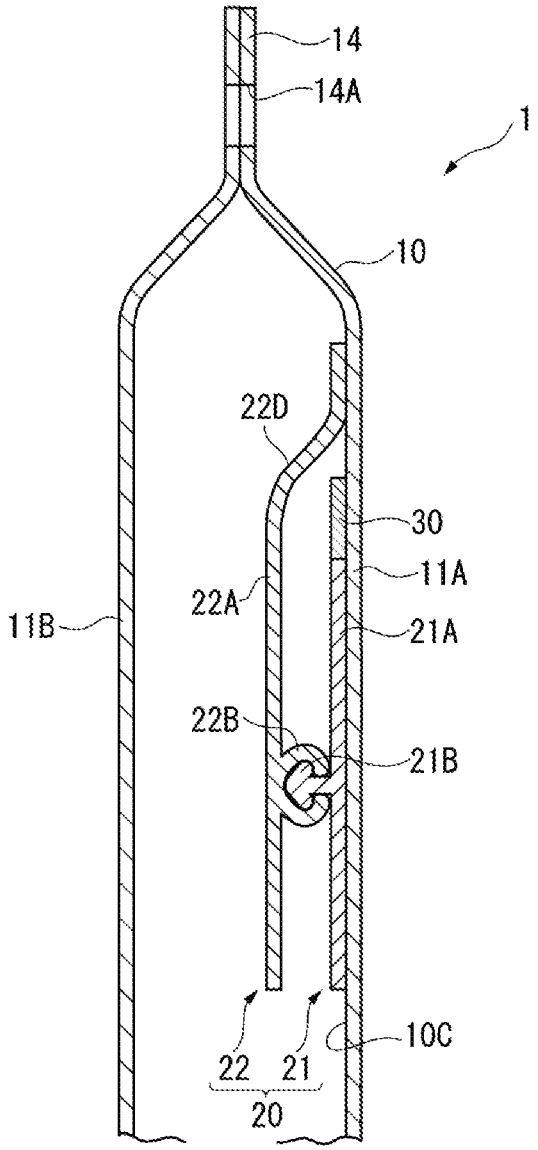
FIG. 2 is a cross sectional view of a relevant part of the zipper-tape bag.

FIG. 2 shows a cross sectional view of a relevant part of the zipper tape 20.

As shown in FIGS. 1 and 2, the zipper tape 20 includes a male member 21 and a female member 22 that are configured to be engaged with and disengaged from each other.

The male member 21 and the female member 22 are both bonded to an inner surface of the film 11A through a suitable process such as heat-sealing and adhesion.

The male member 21 includes a male belt-shaped base 21A having a short width (dimension in an up-down direction in FIG. 2) and a male portion 21B formed continuously with the male belt-shaped base 21A. The male portion 21B is formed along a longitudinal direction of the male belt-shaped base 21A (i.e. in a direction penetrating through FIG. 2).

The female member 22 includes a female belt-shaped base 22A having a long width, and a female portion 22B projecting from the female belt-shaped base 22A and configured to be engaged with or disengaged from the male portion 21B. The female portion 22B is formed along a longitudinal direction of the female belt-shaped base 22A (i.e. in a direction penetrating through FIG. 2).

Herein, the short width of the male belt-shaped base 21A means that, when the male portion 21B and the female portion 22B are engaged, a length from the male portion 21B to an end of the male belt-shaped base 21A in a width direction near the top seal 14 of the bag body 10 is shorter than a length from the female portion 22B to an end of the female belt-shaped base 22A near the top seal 14 of the bag body 10 in the width direction.

In contrast, the female belt-shaped base 22A having a long width has an extension 22D having an elongated length in the width direction.

A surface of the extension of the female belt-shaped base 22A on which the female portion 22B is provided is a bonding surface bonded with the film 11A on which the male belt-shaped base 21A is bonded.

A surface of the female belt-shaped base 22A opposite the surface from which the female portion 22B projects is not bonded to the film 11B.

The zipper tape 20 is made of, for instance, a polyolefin resin. It should be noted that the zipper tape 20 may have a shape retention property (i.e. adapted to keep the shape thereof when being bent in a longitudinal direction).

The polyolefin resin is preferably a polyethylene resin such as a low-density polyethylene or a linear low-density polyethylene, and a polypropylene resin. Examples of the usable polypropylene resin include homo-polypropylene (H-PP), block polypropylene (B-PP), random polypropylene (RPP), and propylene-ethylene-butene-1-random ternary copolymer.

Structure of Tearing Guide Piece

The tearing guide piece 30 is positioned between the film 11A, to which the short-width male belt-shaped base 21A is bonded, and the long-width female belt-shaped base 22A and bonded to the film 11A in parallel to the male belt-shaped base 21A.

In the non-bonded region 16, a surface of the tearing guide piece 30 opposite the surface attached to the film 11A faces the female belt-shaped base 22A. A facing portion, which is defined at the part of the female belt-shaped base 22A facing the tearing guide piece 30, is not bonded with the tearing guide piece 30 (non-bonded state). The non-bonded state means not only that the female belt-shaped base 22A and the tearing guide piece 30 are spaced apart from each other, but also that the female belt-shaped base 22A and the tearing guide piece 30 are in contact with each other but are not bonded.

The tearing guide piece 30 is formed by separating (e.g. cutting) a zipper tape member 2A (see FIG. 6) in parallel to the longitudinal direction into the short-width male belt-shaped base 21A and a part having been separably integrated with an end of the short-width male belt-shaped base 21A in the width direction.

Such separation may be achieved in any way other than the cutting, such as by providing a perforated portion in a form of a dashed cut line like a perforation or a thin portion thinner than the other parts between the male belt-shaped base 21A and the tearing guide piece 30 and cutting the zipper tape member 2A at the perforated portion or the thin portion, or by an interfacial separation at a boundary between the male belt-shaped base 21A and the tearing guide piece.

The tearing guide piece 30 is not necessarily formed of the same material as the material of the zipper tape 20 but may be formed of co-extruded polypropylene resin and high-density polyethylene, oriented polyethylene terephthalate (OPET), oriented polypropylene (OPP), or oriented high-density polyethylene (HDPE).

Opening Trigger of Bag Body

As shown in FIG. 1, an opening trigger 61 is provided at the non-bonded region 16 near one of the point seals 120 of the bag body 10 (left one in FIG. 1).

One end of the tearing guide piece 30 is located at the opening trigger 61 and the other end of the tearing guide piece 30 is located at the other one of the point seals 120.

Figure 3A:
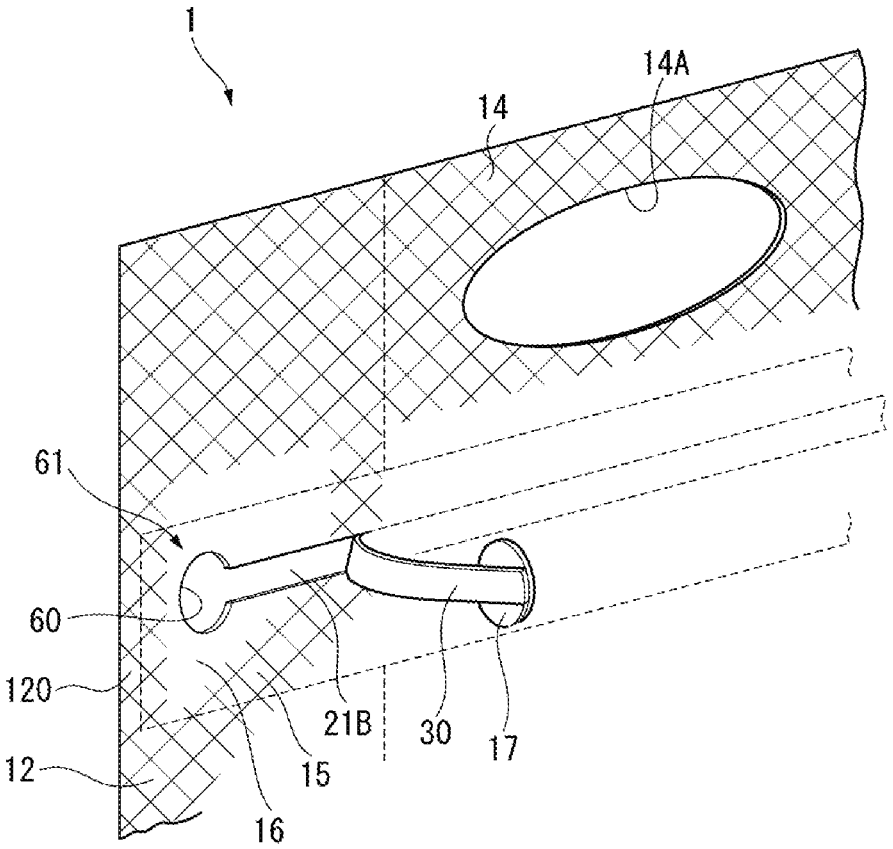
FIG. 3A is a perspective view of a part of the zipper-tape bag.
Figure 3B:
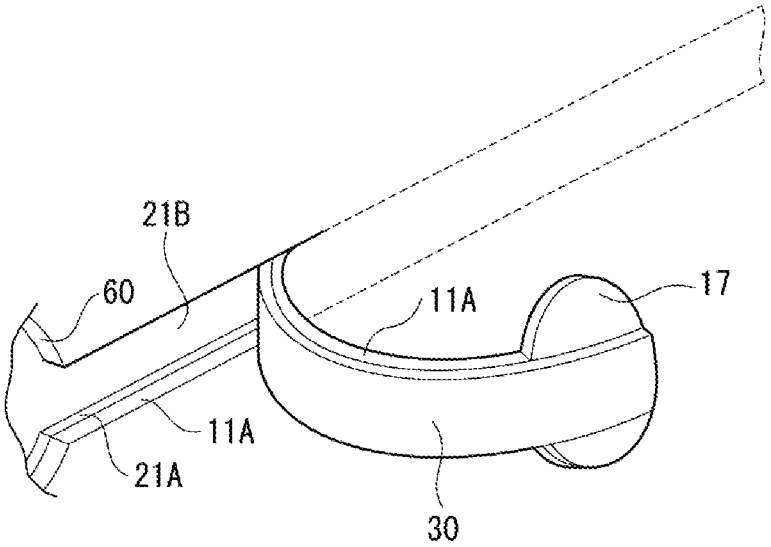
FIG. 3B is a perspective view showing a relevant part of an opening trigger.

FIGS. 3A and 3B show a configuration near the opening trigger 61. FIG. 3A shows a part of the zipper-tape bag 1. FIG. 3B shows a relevant part of the opening trigger 61.

As shown in FIGS. 3A and 3B, the opening trigger 61 is defined by a part of the tearing guide piece 30 and a C-shaped cut portion 60 formed in the film 11A. It should be noted that the shape of the cut portion 60 of the opening trigger 61 is not particularly limited and may be in any shape such as a semicircular shape and a rectangular shape in addition to the C-shaped configuration as long as the cut portion 60 is capable of being easily pinched.

The cut portion 60 of the film 11A and the part of the tearing guide piece 30 are layered and bonded to form an unsealing tab 17 (tab) that is continuous with a longitudinal end of the tearing guide piece 30.

The unsealing tab 17 is formed by cutting the bonded film 11A and the tearing guide piece 30 at the non-bonded region 16 using a C-shaped blade to form the cut portion 60 without cutting the non-bonded female member 22 and film 11B using the C-shaped blade. It should be noted that, since the cut portion 60 is provided within the non-bonded region 16, which is separated from the housing space 10C of the bag body 10 containing the content P, the content P is kept from being leaked out through the cut portion 60.

When the unsealing tab 17 is pinched to pull the tearing guide piece 30, the tearing guide piece 30 linearly tears the film 11A.

It should be noted that, since the tearing guide piece 30 and the film 11A are mutually bonded by heat-sealing or using an adhesive, an interlaminar separation does not occur between the tearing guide piece 30 and the film 11A when the zipper-tape bag 1 is unsealed.

Figure 4:
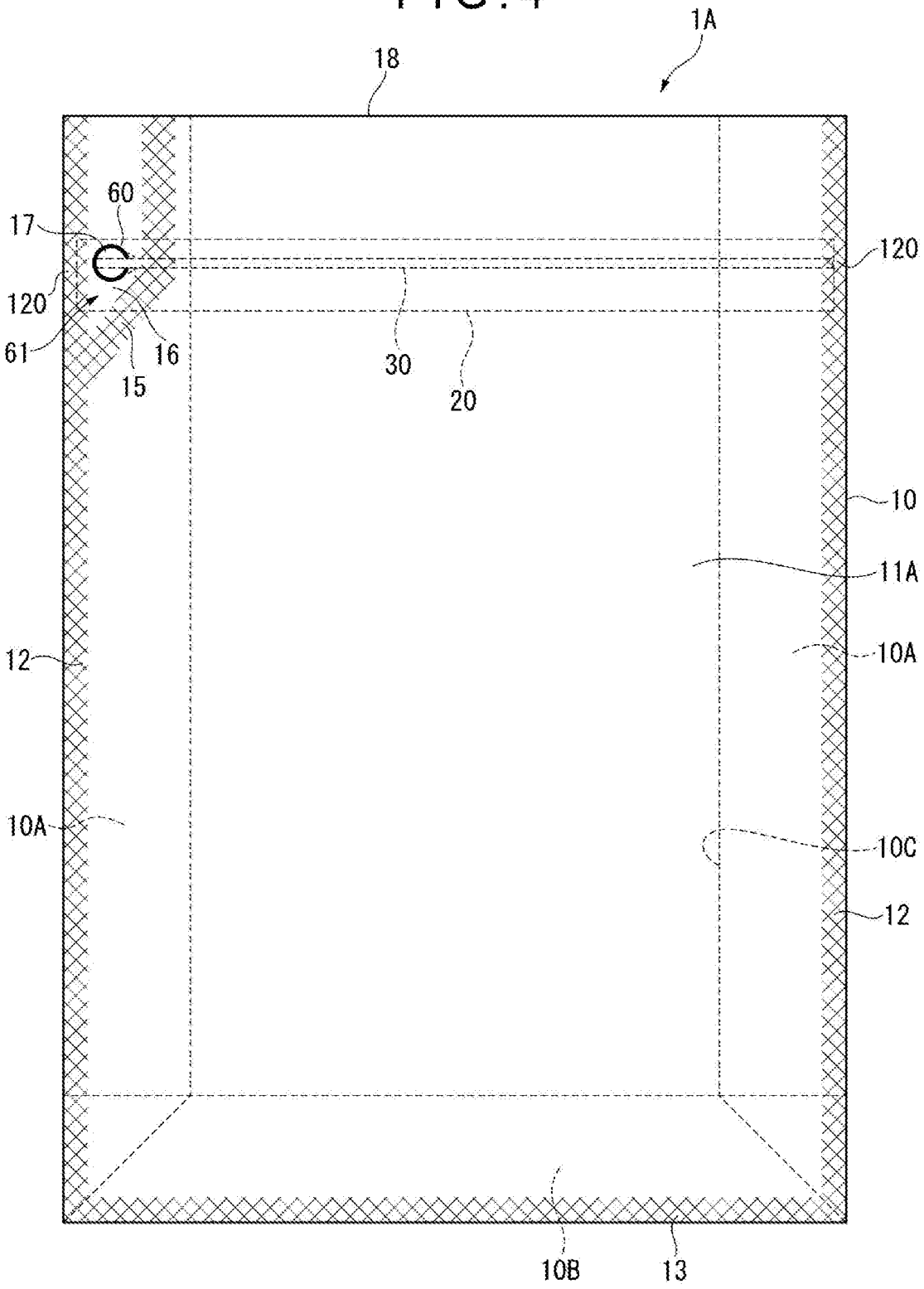
FIG. 4 is a front elevational view showing the zipper-tape bag.
Figure 5:
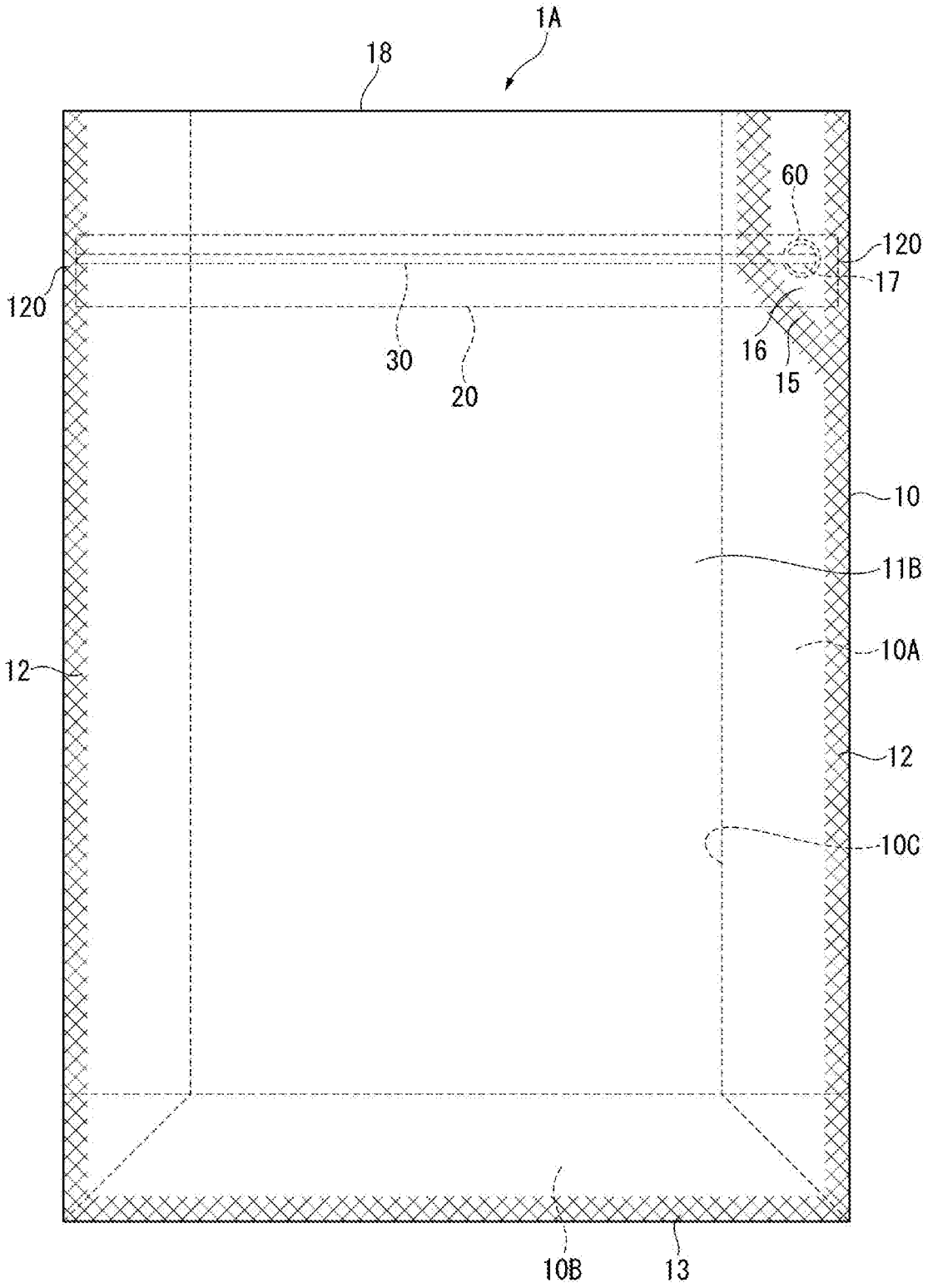
FIG. 5 is a rear elevational view showing the zipper-tape bag.

Before the zipper-tape bag 1 is completely made, a zipper-tape bag 1A without the top seal 14 as shown in FIGS. 4 and 5 is produced. The content P is inputted through an input opening 18 of the zipper-tape bag 1A. Subsequently, the top seal 14 and the grip 14A are provided near a periphery of the input opening 18 of the zipper-tape bag 1A and the input opening 18 is sealed, thereby producing the zipper-tape bag 1 containing the content P.

Manufacture of Zipper-Tape Bag

A process for manufacturing the zipper-tape bag 1A before the content P is inputted will be described below as a part of the process for manufacturing the zipper-tape bag 1 of the first exemplary embodiment. It should be noted that the zipper-tape bag 1A can be manufactured in a variety of processes.

Figure 6:
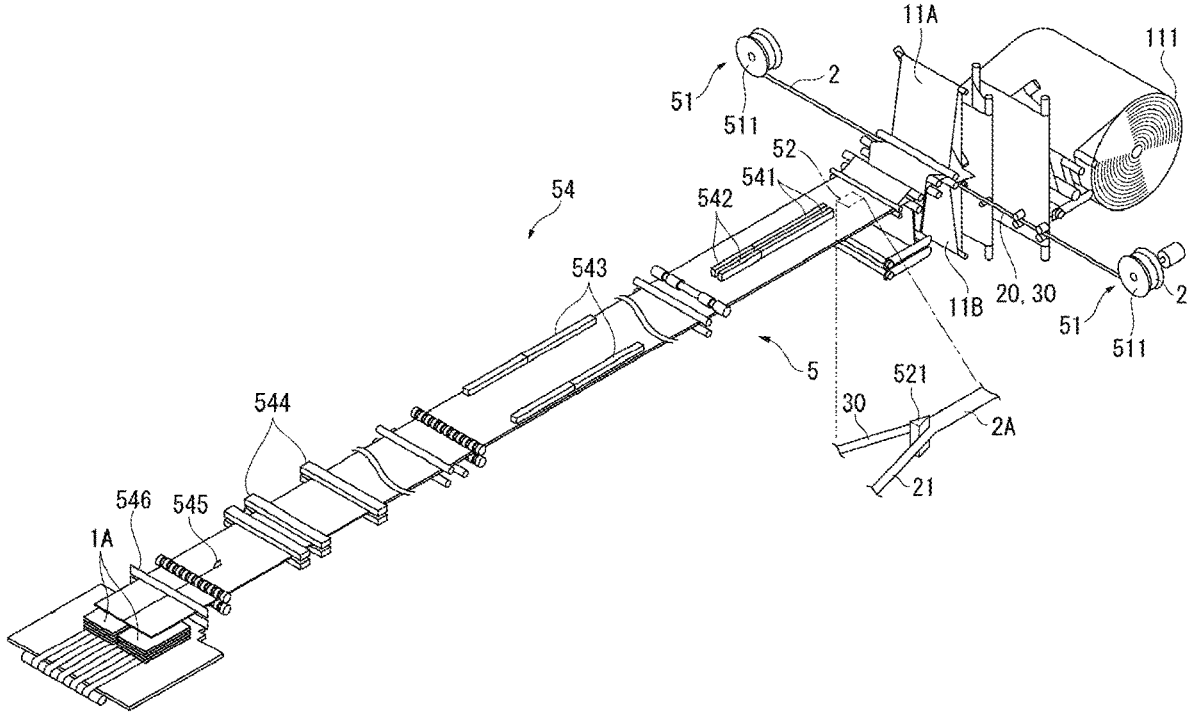
FIG. 6 schematically shows a structure of a manufacturing machine for manufacturing the zipper-tape bag.
Figure 7:
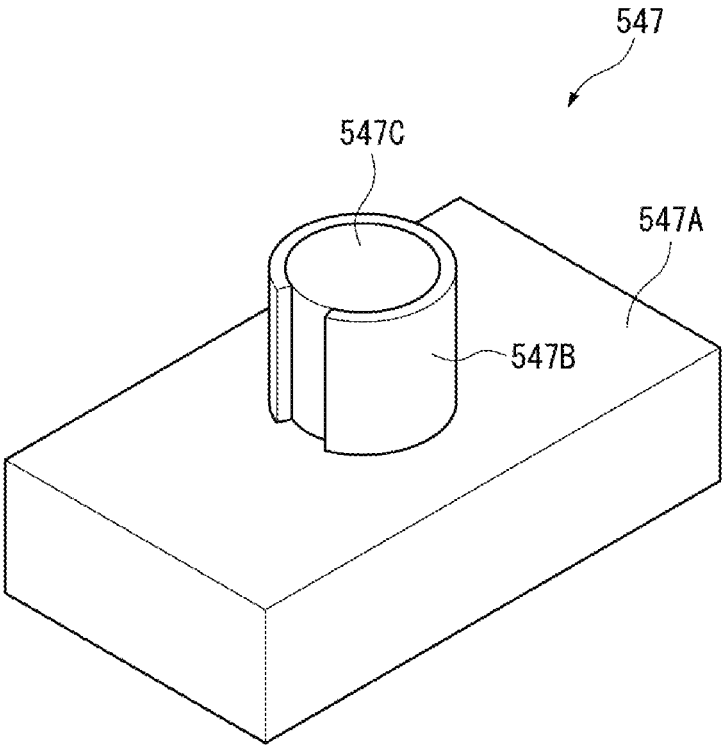
FIG. 7 is a perspective view showing a shaping unit of the manufacturing machine.

FIG. 6 schematically shows a structure of a manufacturing machine for manufacturing the zipper-tape bag. FIG. 7 is a perspective view showing a shaping unit of the manufacturing machine.

Manufacturing Machine

A manufacturing machine 5 shown in FIG. 6 has a basic arrangement of a so-called three-sided bag-making machine and is configured to produce the zipper-tape bag 1A by cutting the zipper tape member 2A into the male member 21 and the tearing guide piece 30 and bonding the male member 21, the tearing guide piece 30 and the female member 22 to the film 11A.

The manufacturing machine 5 includes: a pair of tape feeders 51 each configured to feed the tape 2, in which the male portion 21B of the zipper tape member 2A is engaged with the female portion 22B of the female member 22; a separator 52 configured to cut the tape 2 into the male member 21 and the tearing guide piece 30; and a bag-manufacturing section 54 configured to heat-seal the male member 21, the tearing guide piece 30 and the female member 22 to the film 11A and, subsequently, form the film 11A into the zipper-tape bag 1A.

The location of the separator 52 may be slightly shifted upstream or downstream in the feeding direction of the tape 2. However, in order to keep the separated male member 21 and the tearing guide piece 30 from being stretched due to a tension possibly applied when the tape 2 is fed, the separator 52 is preferably located immediately before a point at which the separated male member 21 and the tearing guide piece 30 are bonded to the film 11A as shown in FIG. 6.

The tape feeder 51 is provided with detachably attached tape-winding rollers 511, around which the tape 2 is wound, and is configured to feed the tape 2. The tape 2 is fed toward the films 11A, 11B from a lateral side of the films 11A, 11B with respect to the feeding direction of the films 11A, 11B and are bent at a predetermined position using a roller or the like in the feeding direction for the films 11A, 11B to be fed into between the films 11A, 11B.

It is not necessary to continuously feed the tape 2 at a constant speed but the tape 2 may be fed in any manner (e.g. intermittently feeding).

The separator 52 is configured to cut the zipper tape member 2A of the tape 2 into the male member 21 and the tearing guide piece 30. For instance, the separator 52 is configured to temporarily disengage the delivered tape 2 and cut the zipper tape member 2A into the male member 21 and the tearing guide piece 30 using a cutting blade 521 disposed at a predetermined position.

The male member 21 and the tearing guide piece 30 having been cut are delivered together with the female member 22 having been disengaged to the bag-manufacturing section 54 located downstream.

The bag-manufacturing section 54 includes: a pair of seal bars 541 configured to heat-seal the male member 21 and the tearing guide piece 30 having been separated by the separator 52 onto the film 11A; a pair of seal bars 542 configured to heat-seal the female member 22 onto the film 11A; a bottom former (not shown) configured to provide the bottom portion to the layered films 11A, 11B; a side former (not shown) configured to provide the lateral portions 10A to the layered films 11A, 11B; a shaping unit 547 (see FIGS. 7, 8); and a first cut portion 545 and a second cut portion 546 configured to cut the films into the zipper-tape bag 1A. The seal bars 541, 542 define an attachment mechanism for attaching the male belt-shaped base 21A and the female belt-shaped base 22A onto the film 11A.

A guide member (not shown) for positioning the male member 21 and the tearing guide piece 30 at a predetermined seal position with respect to the film 11A is provided at an upstream of the seal bar 541. Another guide member (not shown) for positioning the female member 22 at predetermined seal positions with respect to the film 11A is provided upstream of the seal bar 542.

The guide members are exemplarily each in a form of: a concave groove formed on a circumferential surface of a roller, the concave groove having a width corresponding to the width of the male member 21 and the male portion 21B or the width of the tearing guide piece 30; or a frame member having an opening whose cross sectional profile is substantially the same as that of the male member 21, the male portion 21B or the tearing guide piece 30.

The bottom former includes a bottom seal bar 543 configured to heat-seal the bottom portion 10B to the films 11A, 11B to form the bottom seal 13.

The side former includes a side seal bar 544 configured to heat-seal the lateral portions 10A to the films 11A, 11B to form the side seals 12 and the partition seal 15.

It should be noted that the film 11A is not necessarily heat-sealed to the male member 21, the female member 22 and the tearing guide piece 30, but may be attached by various methods such as welding using ultrasonic waves and bonding using an adhesive.

Figure 8A:
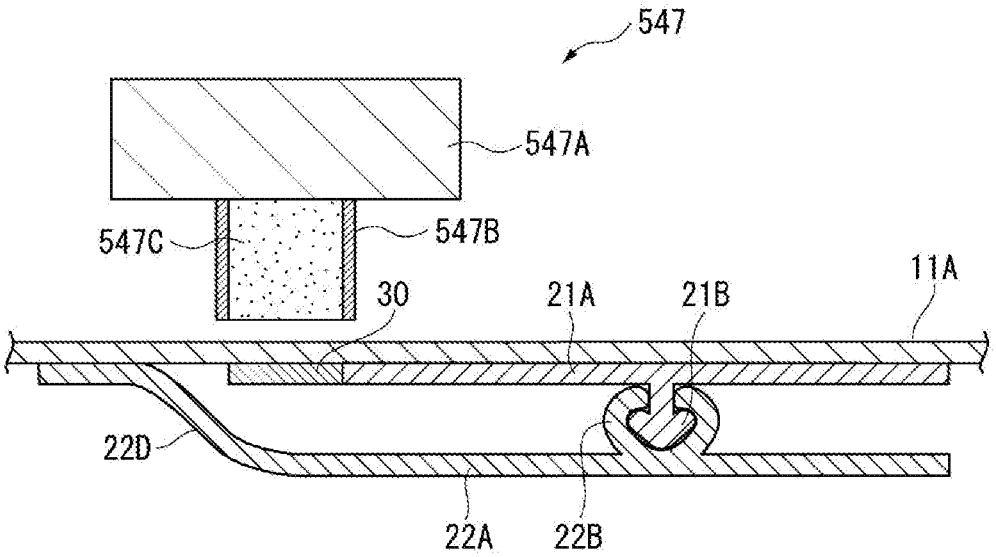
FIG. 8A is a cross sectional view of a relevant part before being machined, for illustrating formation of an opening trigger using the shaping unit.
Figure 8B:
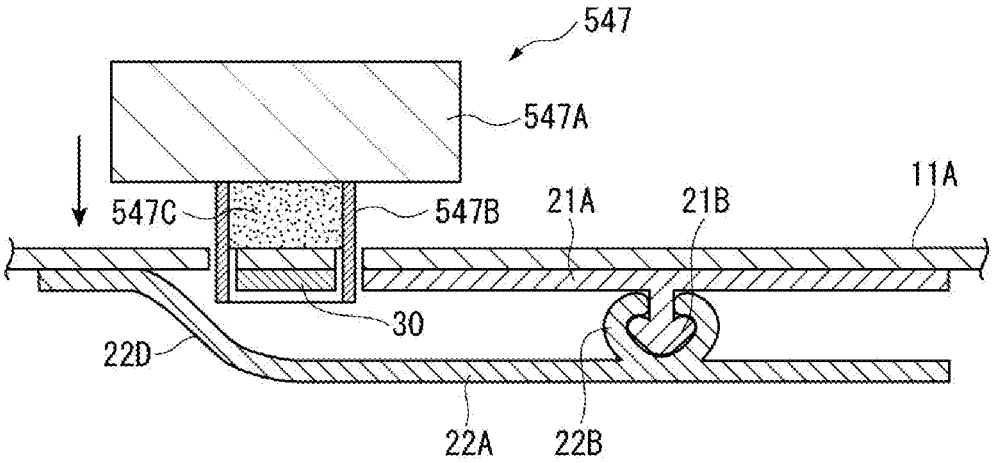
FIG. 8B is a cross sectional view of a relevant part being machined, for illustrating formation of the opening trigger using the shaping unit.

As shown in FIGS. 7, 8A and 8B, the shaping unit 547 includes: a support 547A; a C-shaped shaping blade 547B (blade) provided upright on the support 547A; a rubber 547C (movement restrictor) provided at an inside of the shaping blade 547B and having a height corresponding to a distance from a surface of the support 547A to a distal end of the shaping blade 547B, the rubber 547C restricting a movement of the shaping blade 547B; and a driver (not shown) configured to, for instance, pneumatically advance and retract the support 547A.

As shown in FIG. 8A, the shaping unit 547 stands by at a position remote from the film 11A. When the support 547A is advanced by the driver, the film 11A and the tearing guide piece 30 are cut through from an outside of the film 11A with the shaping blade 547B as shown in FIG. 8B to provide the C-shaped cut portion 60 and, consequently, the opening trigger 61. When the shaping unit 547 is driven, the tearing guide piece 30 and the facing portion of the female belt-shaped base 22A are in a non-bonded state. Accordingly, the facing portion of the female belt-shaped base 22A facing the tearing guide piece 30 are not cut with the shaping blade 547B.

In order to regulate the cutting depth of the shaping blade 547B so that the films are half-cut, an elastic force of the rubber 547C and the pneumatic force of the driver may be adjusted depending on the thickness and material of the film 11A and the zipper tape 20 so that the shaping blade 547B is movable only to a predetermined depth from the surface of the film 11A. More specifically, the rubber 547C may be replaced with a different rubber having a different elastic force.

A filling machine (not shown) for filling the formed zipper-tape bag 1A with the content P is provided downstream of the manufacturing machine 5. The filling machine includes a seal bar (not shown) for forming the top seal 14.

In the first exemplary embodiment, the side seal bar 544, the shaping unit 547 and the non-illustrated seal bar for forming the top seal 14 define at least a part of a mechanism for forming the tab. In this mechanism, the side seal bar 544 and the seal bar for forming the top seal 14 provide a mechanism for bonding a circumference of the non-bonded region 16 without bonding the non-bonded region 16. In order to keep the tearing guide piece 30 and the facing portion of the female belt-shaped base 22A positioned within the non-bonded region 16 from being bonded using the above mechanism, for instance, the shape of the seal bar may be designed so that the seal bar does not comes into contact with the portion corresponding to the non-bonded region 16.

Manufacturing Method of Zipper-Tape Bag

Next, a process for manufacturing the zipper-tape bag 1A, which has not contained the content P for the zipper-tape bag 1, using the manufacturing machine 5 will be described below with reference to the attached drawings.

The manufacturing method of the zipper-tape bag 1A is conducted using, for instance, the manufacturing machine 5 for a three-sided bag-making process shown in FIG. 6. The manufacturing method includes: feeding the tape 2 (tape feeding step); cutting the tape 2 into the male member 21 and the tearing guide piece 30 (separation step); attachment step for heat-sealing the male member 21, the tearing guide piece 30 and the female member 22 to the film 11A (attachment step); and forming the film 11A into the zipper-tape bag 1A (bag-making step).

Initially, the long-width female member 22 and the zipper tape member 2A, which includes the short-width male member 21 integrated with the tearing guide piece 30, are separately formed by extrusion or the like. Then, the female portion 22B of the female member 22 and the male portion 21B of the zipper tape member 2A are engaged to form the integrated tape 2. The tape 2 is wound around each of the tape-winding rollers 511.

In the tape feeding step, the tape 2 drawn from the tape-winding roller 511 is delivered into between the layered films 11A, 11B, which have been obtained by halving the film fed from a film-winding roller 111.

In the separation step, the zipper tape member 2A of the tape 2 delivered from the tape feeder 51 is cut using the cutting blade 521 of the separator 52 into the male member 21 and the tearing guide piece 30.

The male member 21 and the tearing guide piece 30 having been cut are guided by the position guide member (not shown) into a predetermined positional relationship with respect to the film 11A while being layered.

In the attachment step, a predetermined bonding region of the male member 21 and the tearing guide piece 30 are bonded (i.e. heat-sealed) to the film 11A using the seal bar 541.

Subsequently, the female member 22 is guided to be layered on a predetermined position of the film 11A attached with the male member 21 and the tearing guide piece 30. Then, a predetermined bonding region of the female member 22 is heat-sealed on the film 11A using the seal bar 542.

In the bag making step, the film 11B is layered on the film 11A on which the male member 21, the female member 22 and the tearing guide piece 30 are attached in the attachment step. Subsequently, the pair of lateral portions 10A and the bottom portion 10B are provided. The films 11A, 11B are heat-sealed using the bottom seal bar 543 to form the bottom seal 13. The films 11A, 11B are further heat-sealed using the side seal bar 544 to form the side seals 12 and the partition seal 15. When the side seals 12 and the partition seal 15 are formed, ends of the zipper tape 20 and the tearing guide piece 30 are bonded to the films 11A, 11B. In the first exemplary embodiment, the non-bonded region 16, at which the tearing guide piece 30 is not bonded to the facing portion of the female belt-shaped base 22A, is formed between one of the side seals 12 and the partition seal 15. The seal bar is designed to keep the tearing guide piece 30 from being bonded to the facing portion of the female belt-shaped base 22A at the non-bonded region 16.

Subsequently, the cut portion 60 is provided to the non-bonded region 16 of the bag body 10 to form the tab. In order to form the tab, the shaping unit 547 is used to cut the film 11A and a part of the tearing guide piece 30 without cutting the film 11B and the female belt-shaped base 22A to form the cut portion 60.

After the content P is inputted into the thus produced zipper-tape bag 1A, the top seal 14 and the grip 14A are formed.

Use of Zipper-Tape Bag

The use of the zipper-tape bag 1 will be described below with reference to the attached drawings.

Figure 9:
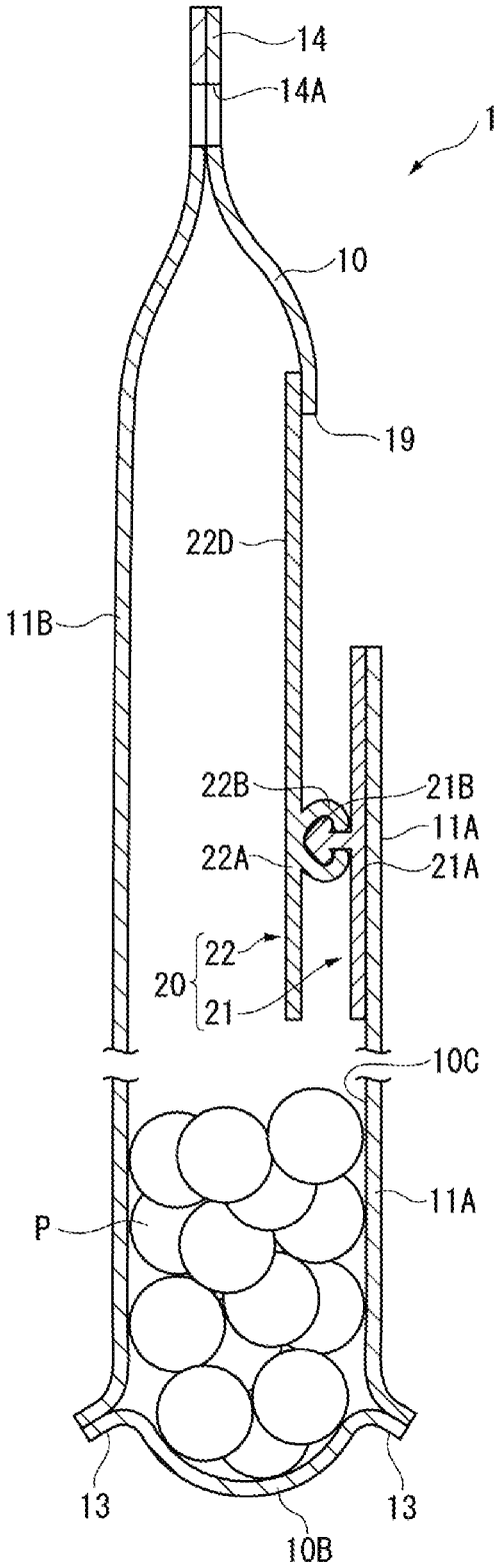
FIG. 9 is a cross sectional view showing the zipper-tape bag containing a content and having been unsealed using a tearing guide piece.

FIG. 9 is a cross section illustrating the zipper-tape bag having been unsealed.

When a user takes out the content P from the zipper-tape bag 1 for the first time, the user pulls the unsealing tab 17 formed on the opening trigger 61 as shown in, for instance, FIG. 3A. The film 11A and the tearing guide piece 30 are pulled in conjunction with pulling the unsealing tab 17. Then, the film 11A of the zipper-tape bag 1 starts being torn.

When the torn part of the film 11A reaches the partition seal 15, the tearing guide piece 30 tears the film 11A while being peeled off from the female belt-shaped base 22A. The tearing guide piece 30 thus linearly tears the film 11A, thereby making an opening at the opening 19 as shown in FIG. 9 to unseal the bag.

After the unsealing, the opening edges of the opening 19 are widely separated to release the engagement between the male portion 21B and the female portion 22B, whereby the housing space 10C is open to an outside through an opening 19. When the housing space 10C is open to the outside, the inputted content P can be taken out.

When the male portion 21B and the female portion 22B are subsequently engaged, the housing space 10C is sealed again.

Advantage of First Exemplary Embodiment

As described above, in the first exemplary embodiment, the unsealing tab 17 is formed by cutting the film 11A, which is attached with the tearing guide piece 30 and the short-width male belt-shaped base 21A, at the non-bonded region 16 where the tearing guide piece 30 and the long-width female belt-shaped base 22A are non-bonded. Accordingly, the unsealing tab 17 can be easily formed by simply cutting the film 11A, thereby improving the productivity.

In the first exemplary embodiment, the tearing guide piece 30 is separated from the zipper tape member 2A before the tearing guide piece 30 is attached to the film 11A.

Accordingly, when the tearing guide piece 30, which has already been independently heat-sealed to the film 11A, is used to tear and unseal the bag body 10, no force for separating the tearing guide piece 30 from the male member 21 is necessary but only a force for tearing the bag body 10 is necessary, so that a large load is not applied in unsealing the bag.

In particular, the tearing guide piece 30 and the male member 21 of the zipper tape 20 are integrated as the zipper tape member 2A and are separated immediately before being attached to the film 11A. Accordingly, even when a tension causing different degree of stretch is applied during a production process, the female member 22, the male member 21 and the tearing guide piece 30 can be positioned and attached to a predetermined position before these components are stretched. Thus, the female member 22, the male member 21 and the tearing guide piece 30 are kept from being stretched at different rates, so that the female member 22, the male member 21 and the tearing guide piece 30 can be attached to the film 11A without causing wrinkles and the like on the film, thereby preventing deterioration in the yield rate and achieving favorable production.

In particular, since the cutting blade 521 of the separator 52 is used for separation, the tearing guide piece 30 can be easily separated from the zipper tape member 2A.

Additionally, the zipper tape member 2A including the short-width male member 21 integrated with the tearing guide piece 30 is used in the first exemplary embodiment.

Accordingly, the zipper tape member 2A can be easily manufactured with a simple arrangement, and the tearing guide piece 30 and the zipper tape 20 can be easily separated.

Further, since the tearing guide piece 30 and the female belt-shaped base 22A are not bonded in the non-bonded region 16, smooth unsealing of the bag is expectable.

It should be noted that the following arrangement is usable in order to use the zipper tape member 2A integrally provided with the tearing guide piece 30 and to separate the tearing guide piece 30 before the zipper tape member 2A is attached to the film 11A. Specifically, when the zipper tape member 2A integrated with the tearing guide piece 30 is attached to the film 11A and the tearing guide piece 30 is pulled to tear the bag body 10 when the bag is unsealed, a force for tearing the tearing guide piece 30 from the male member 21 may become necessary in addition to the force for tearing the bag body 10. An exemplary means for solving the above problem is as follows.

A manufacturing method for manufacturing a zipper-tape bag including: a bag body formed by bending a single film or layering at least two sheets of film; a zipper tape including a female member including a female belt-shaped base attached to one of opposing inner surfaces of the bag body and a female portion provided on the female belt-shaped base, and a male member including a male belt-shaped base attached to the one of opposing inner surfaces of the bag body and a male portion, which is engageable with the female member, provided on the male belt-shaped base, a width of one of the female belt-shaped base and the male belt-shaped base being elongated toward an end in the width direction with respect to a width of the other of the female belt-shaped base and the male belt-shaped base; and a longitudinal separation strip disposed between the female belt-shaped base and the male belt-shaped base or between the film attached with shorter-width one of the female belt-shaped base and the male belt-shaped base and longer-width one of the female belt-shaped base and the male belt-shaped base, the separation strip being configured to cut the film attached with the shorter-width one of the female belt-shaped base and the male belt-shaped base to form the opening in the bag body, the method, which is performed by using a zipper tape member integrally including the shorter-width one of the female belt-shaped base and the male belt-shaped base and the separation strip, includes separating the separation strip of the zipper tape member from the shorter-width one of the female belt-shaped base and the male belt-shaped base, and attaching the separated shorter-width one of the female belt-shaped base and the male belt-shaped base and the separation strip to the film.

According to the above arrangement, the separation strip is already separated from the zipper tape when being attached to the film. Thus, no force for separating the separation strip from the male belt-shaped base or the female belt-shaped base is necessary when the separation strip tears the bag body but only a force for tearing the bag body is necessary, so that a large load is not applied in unsealing the bag. In particular, since the separation strip is separated from the zipper tape immediately before being attached to the film, even when a tension causing different degree of stretch is applied during the production process, the female member, the male member and the separation strip can be appropriately positioned and attached at predetermined positions before being stretched. Thus, the female member, the male member and the separation strip are kept from being stretched at different rates, so that the female member, the male member and the separation strip can be attached to the film without causing wrinkles and the like on the film, thereby preventing deterioration in the yield rate and achieving favorable production.

Second Exemplary Embodiment

Next, a second exemplary embodiment of the invention will be described below with reference to FIGS. 10A and 10B.

The second exemplary embodiment is the same as the first exemplary embodiment except for the structure of the base.

Figure 10A:
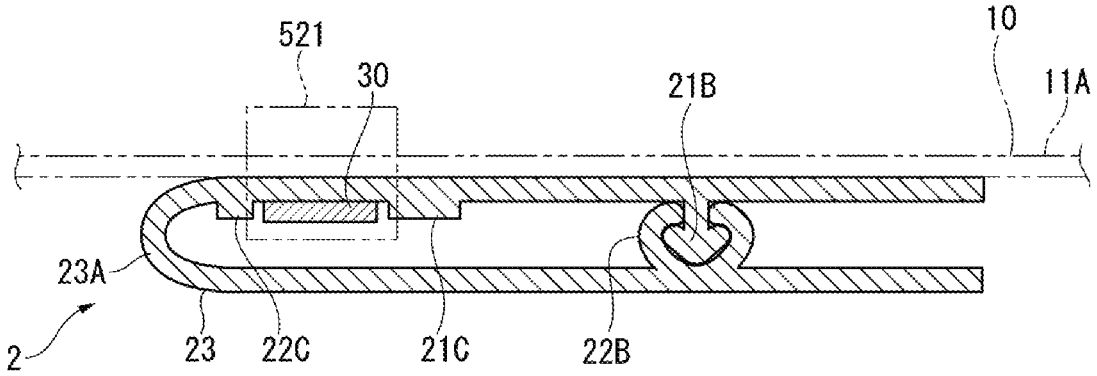
FIG. 10A is a cross sectional view of a relevant part of a tape for showing a manufacturing process of a zipper-tape bag according to a second exemplary embodiment of the invention.
Figure 10B:
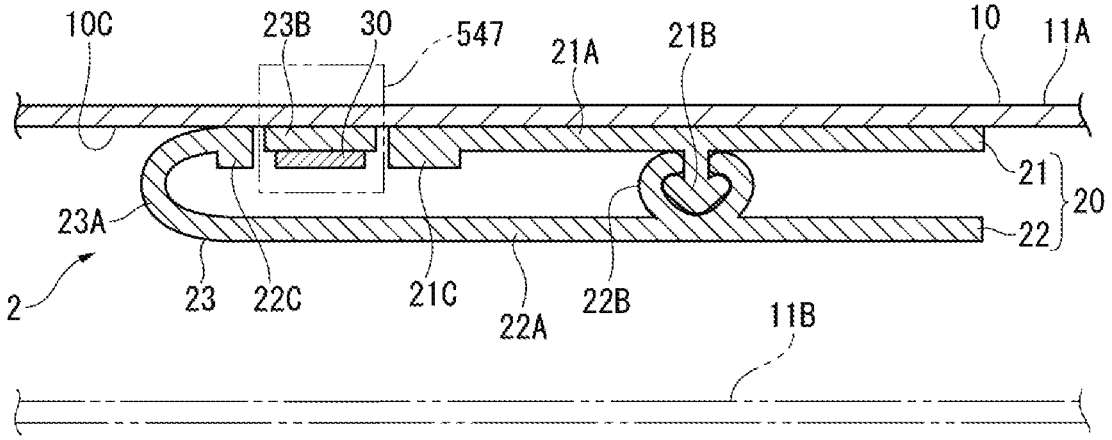
FIG. 10B is another cross sectional view of the relevant part of the zipper-tape bag for showing the manufacturing process of the zipper-tape bag according to the second exemplary embodiment of the invention.

FIGS. 10A and 10B are cross sectional views of a relevant part of the zipper-tape bag according to the second exemplary embodiment. FIG. 10A is a cross sectional view of a relevant part of the tape. FIG. 10B is another cross sectional view of the relevant part of the zipper-tape bag.

Structure of Tape

As shown in FIG. 10A, the tape 2 of the second exemplary embodiment includes: a longitudinal belt-shaped portion 23 having a bent portion 23A (folded portion) folded substantially at a width center of the belt-shaped portion 23; the male portion 21B and the female portion 22B arranged in parallel along the longitudinal direction of the belt-shaped portion 23; and the tearing guide piece 30 disposed on the belt-shaped portion 23 between and in parallel to the male portion 21B and the female portion 22B. In the second exemplary embodiment, the zipper tape includes the belt-shaped portion 23, the male portion 21B and the female portion 22B. The tearing guide piece 30 is provided on the belt-shaped portion 23.

The facing portion is defined at a portion of the folded belt-shaped portion 23 facing the tearing guide piece 30 through a gap S. The tearing guide piece 30 and the facing portion are not bonded at the non-bonded region 16.

The male portion 21B and the female portion 22B are equidistant from the bent portion 23A to be opposed and engageable with each other.

First and second convex portions 21C, 22C thicker than the belt-shaped portion 23 are provided on the belt-shaped portion 23. The first convex portion 21C and the second convex portion 22C are located between the male portion 21B and the bent portion 23A to be spaced apart in the width direction of the belt-shaped portion 23 when the belt-shaped portion 23 is folded at the bent portion 23A and the male portion 21B and the female portion 22B are engaged. The distance between the first convex portion 21C and the second convex portion 22C is the same as or slightly larger than the width of the tearing guide piece 30.

The tearing guide piece 30 is provided between the first convex portion 21C and the second convex portion 22C and is laminated on the belt-shaped portion 23. In other words, when the tearing guide piece 30 is separated from the zipper tape using, for instance, the cutting blade 521 of the separator 52, the width of the male member 21 becomes short whereas the width of the female member 22 becomes long, as shown in FIG. 10B.

It should be noted that the first and second convex portions 21C, 22C and the tearing guide piece 30 may alternatively be provided between the female portion 22B and the bent portion 23A. In this case, when the male member 21, the female member 22 and the tearing guide piece 30 are separated, the width of the female member 22 becomes short whereas the width of the male member 21 becomes long. It should be noted that the tearing guide piece 30 may be laminated on the belt-shaped portion 23 without providing the first and second convex portions 21C, 22C.

Manufacture of Zipper-Tape Bag

In order to manufacture the zipper-tape bag 1, the manufacturing machine 5 in the first exemplary embodiment is used to manufacture the zipper-tape bag 1A (i.e. the zipper-tape bag 1 before the top seal 14 is formed).

The shaping unit 547 of the manufacturing machine 5 is configured to cut the tearing guide piece 30 and the film 11A attached with the zipper tape 20 to form the cut portion 60 without cutting the facing portion of the base portion of the belt-shaped portion 23 and the film 11B, with the folded belt-shaped portion 23 and the tearing guide piece 30 not being bonded (see FIG. 1).

In order to manufacture the zipper-tape bag 1A using the manufacturing machine 5, the drawn tape 2 is cut at both ends of the tearing guide piece 30 in the width direction using the cutting blade 521 of the separator 52 to separate the tape 2 into the zipper tape 20, in which the male portion 21B of the short-width male member 21 is engaged with the female portion 22B of the long-width female member 22, and the tearing guide piece 30. A part 23B (see FIG. 10B) of the belt-shaped portion 23 is laminated on the tearing guide piece 30 having been cut out. It should be noted that, for the convenience of showing that the tearing guide piece 30 has been cut, a gap is illustrated between the male member 21 and the tearing guide piece 30 and between the female member 22 and the tearing guide piece 30 in FIG. 10B. However, the zipper tape 20 is substantially in contact with the tearing guide piece 30 in an actual product.

The separated zipper tape 20 and the tearing guide piece 30 are guided by a position guide member (not shown) into a predetermined positional relationship with respect to the film 11A and heat-sealed. It should be noted that the tearing guide piece 30 is heat-sealed to the film 11A through the part 23B of the belt-shaped portion 23. Further, the female member 22 is heated from the side of the film 11A to heat-seal the second convex portion 22C onto the film 11A.

The lateral portion 10A and the bottom portion 10B are provided to the layered films 11A, 11B and the tab is formed. Specifically, the side seal bar 544 is used to form the side seals 12 and the partition seal 15. The region interposed between the seals define the non-bonded region 16. The facing portion of the folded belt-shaped portion 23 and the tearing guide piece 30 are not bonded at the non-bonded region 16. The shaping unit 547 cuts the tearing guide piece 30 and the film 11A attached with the zipper tape 20 without cutting the facing portion of the base portion of the belt-shaped portion 23 and the film 11B to form the cut portion 60.

After the content P is inputted into the thus produced zipper-tape bag 1A, the top seal 14 and the grip 14A are formed.

Advantage of Second Exemplary Embodiment

In the second exemplary embodiment, the tape 2, which includes the belt-shaped portion 23 integrally including the male portion 21B and the female portion 22B and the tearing guide piece 30 integrated with the belt-shaped portion 23, is heat-sealed to the film 11A after the tape 2 is cut into the male member 21, the female member 22 and the tearing guide piece 30.

According to the above arrangement, since the tearing guide piece 30 has been separated into an independent component, a force for separating the tearing guide piece 30 from the belt-shaped portion 23 is not necessary when the bag body 10 is torn to unseal the bag. Accordingly, only a force for tearing the bag body 10 is required in order to unseal the bag, so that a large load is not applied in an unsealing process.

It should be noted that the following arrangement is usable in order to separate the zipper tape 2 integrally provided with the tearing guide piece 30 before the zipper tape 2 is attached to the film 11A in the second exemplary embodiment.

A manufacturing method for manufacturing a zipper-tape bag including: a bag body formed by bending a single film or layering at least two sheets of film; a zipper tape including a female member including a female belt-shaped base attached to one of opposing inner surfaces of the bag body and a female portion provided on the female belt-shaped base, and a male member including a male belt-shaped base attached to the one of opposing inner surfaces of the bag body and a male portion, which is engageable with the female member, provided on the male belt-shaped base, a width of one of the female belt-shaped base and the male belt-shaped base being elongated toward an end in the width direction with respect to a width of the other of the female belt-shaped base and the male belt-shaped base with the female portion and the male portion being engaged; and a longitudinal separation strip disposed between the female belt-shaped base and the male belt-shaped base or between the film attached with shorter-width one of the female belt-shaped base and the male belt-shaped base and longer-width one of the female belt-shaped base and the male belt-shaped base, the separation strip being configured to cut the film attached with the shorter-width one of the female belt-shaped base and the male belt-shaped base to form the opening in the bag body, the method, which is performed by using a zipper tape member including the female member, the male member, the belt-shaped portion provided with the female member and the male member, and the separation strip located on the belt-shaped portion between the female member and the male member, includes dividing the belt-shaped portion at both ends of the separation strip of the zipper tape member in the width direction to separate the belt-shaped portion into the female member, the male member and the separation strip, and attaching the separated shorter-width one of the female belt-shaped base of the female member and the male belt-shaped base of the male member and the separation strip to the film.

According to the above arrangement, even with the use of the zipper tape member integrally provided with the male portion and the female portion, the separation strip is already separated from the zipper tape when being attached to the film.

Thus, no force for separating the separation strip from the male belt-shaped base or the female belt-shaped base is necessary when the separation strip tears the bag body but only a force for tearing the bag body is necessary, so that a large load is not applied in unsealing the bag.

In particular, since the separation strip is separated from the zipper tape immediately before being attached to the film, even when a tension causing different degree of stretch is applied during the production process, the female member, the male member and the separation strip can be appropriately positioned and attached at predetermined positions before being stretched. Thus, the female member, the male member and the separation strip are kept from being stretched at different rates, so that the female member, the male member and the separation strip can be attached to the film without causing wrinkles and the like on the film, thereby preventing deterioration in the yield rate and achieving favorable production.

Third Exemplary Embodiment

Next, a third exemplary embodiment of the invention will be described below with reference to FIGS. 11 to 15.

The third exemplary embodiment is different from the first exemplary embodiment in that the zipper tape is attached to the bag and the separation strip is provided to the bag body via a base.

Structure of Bag

FIGS. 11, 12, 13A and 13B shows a bag according to the third exemplary embodiment.

Figure 11:
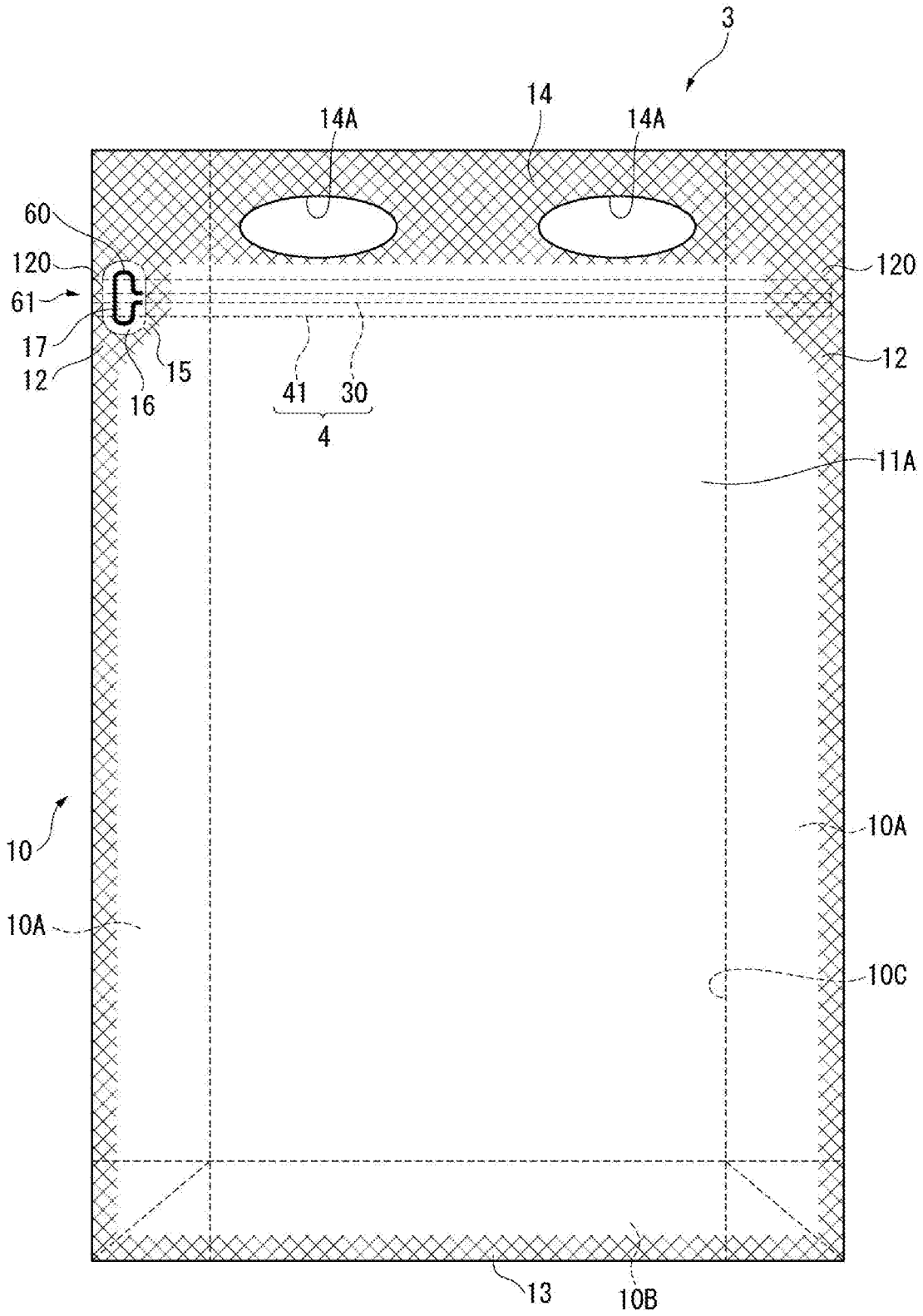
FIG. 11 is a front elevational view showing a bag according to a third exemplary embodiment of the invention.

As shown in FIG. 11, the bag 3 includes the bag body 10, and a tape 4 bonded to one of inner surfaces of the bag body 10.

The bag body 10 is provided with the side seals 12, the bottom seal 13, the top seal 14 and the partition seal 15. The region surrounded by one of the side seals 12, the top seal 14 and the partition seal 15 defines the non-bonded region 16. The profile of the non-bonded region 16 is ellipsoidal in a plan view. The opening trigger 61 is formed in the non-bonded region 16.

Figure 12:
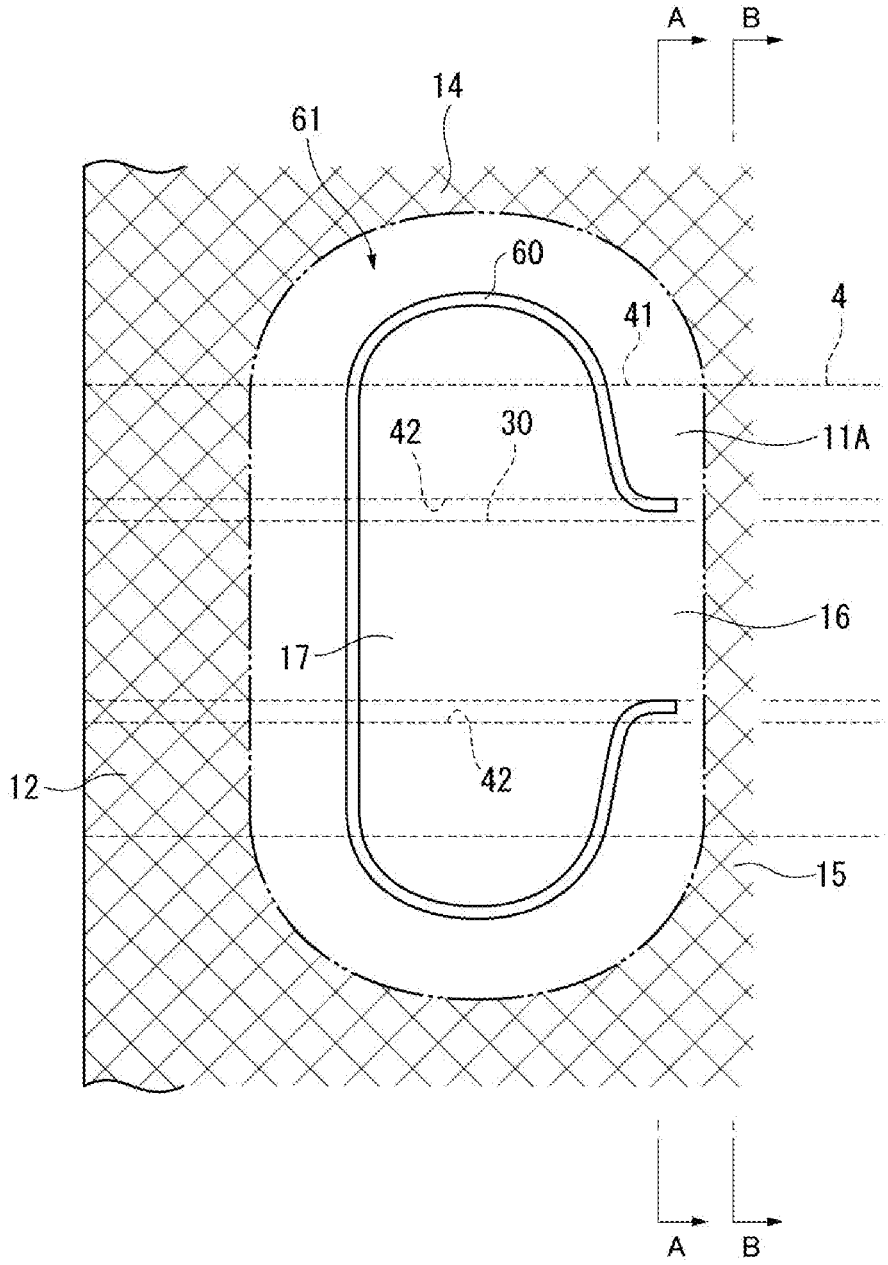
FIG. 12 is a front elevational view showing a relevant part of an opening trigger of the bag in an enlarged manner.

FIG. 12 illustrates a part near the opening trigger shown in FIG. 11 in an enlarged manner.

As shown in FIG. 12, the opening trigger 61 includes a part of the tape 4 and the C-shaped cut portion 60 formed in the film 11A.

The cut portion 60 of the film 11A and the part of the tape 4 form the unsealing tab 17 that is continuous with a longitudinal end of the tape 4.

Figure 13A:
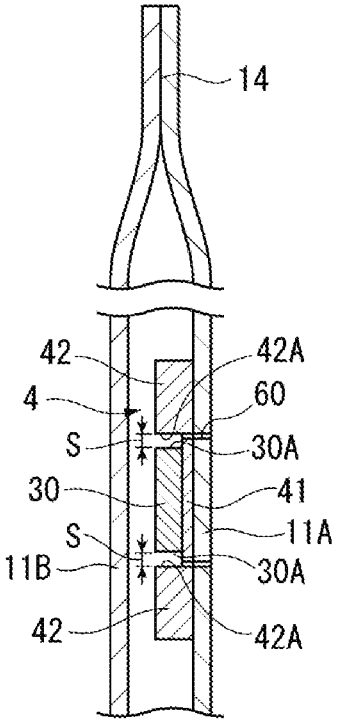
FIG. 13A is a cross sectional view taken along A-A line and viewed in a direction indicated by arrows in FIG. 12.

The unsealing tab 17 is formed by piercing the film 11A and the tape 4 with the C-shaped blade at the position of the non-bonded region 16 without piercing the film 11B (see FIG. 13A).

Figure 13B:
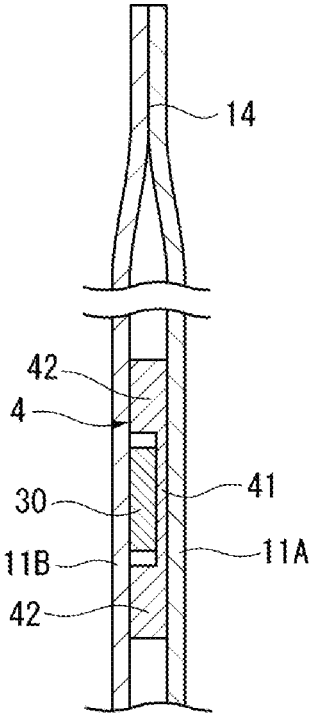
FIG. 13B is a cross sectional view taken along B-B line and viewed in a direction indicated by arrows in FIG. 12.

FIG. 13A shows a cross section taken along lines A-A traversing the tape 4 in the non-bonded region 16 shown in FIG. 12. FIG. 13B shows a cross section taken along lines B-B traversing the tape 4 in the partition seal 15 shown in FIG. 12.

As shown in FIGS. 13A and 13B, the tape 4 includes an elongated base 41 bonded to the film 11A at a first side thereof, the tearing guide piece 30 bonded along the longitudinal direction of the base 41 to a second side of the base 41 opposite the first side, and protrusions 42 integrally formed to the base 41.

The base 41 is an elongated member extending along the top seal 14 (see FIG. 11). The base 41 has a rectangular cross sectional profile in a plane orthogonal to a longitudinal direction of the base 41.

The tearing guide piece 30 is a longitudinal separation strip that tears the film 11A and the base 41 to form the opening.

Though the cross sectional profile of the tearing guide piece 30 is rectangular in FIGS. 13A and 13B, the cross sectional profile of the tearing guide piece 30 is not necessarily rectangular, but may alternatively be triangular or semicircular in the third exemplary embodiment. Further alternatively, the tearing guide piece 30 may be a string-shaped component.

The protrusions 42 protrude from parts of the base 41 not bonded with the tearing guide piece 30 in a direction orthogonal to the side of the base 41 at which the tearing guide piece 30 is bonded.

The protrusions 42 are provided on both sides in a width direction of the base 41 across the tearing guide piece 30.

Though the cross sectional profile of the protrusions 42 is rectangular in FIGS. 13A and 13B, the cross sectional profile of the protrusions 42 is not necessarily rectangular but may alternatively be triangular, semicircular or the like.

Mutually opposing surfaces 30A, 42A of the tearing guide piece 30 and the protrusion 42 are not in contact with each other. In other words, a gap S is present between each of the surfaces 30A of the tearing guide piece 30 facing corresponding one of the protrusions 42 and the surface 42A of the corresponding one of the protrusions 42 facing the tearing guide piece 30. The gap S is formed along the longitudinal direction of the tape 4.

The base 41 and the protrusions 42 are integrally made of the same material.

The base 41, which has been integrally provided with the tearing guide piece 30, is attached to the film 11A defining one of the inner surfaces of the bag body 10.

As shown in FIG. 13A, a part of the film 11B facing the tearing guide piece 30 (facing portion) is not bonded to a surface of each of the tearing guide piece 30 and the protrusions 42 opposite the surface attached with the base 41 at the non-bonded region 16.

As shown in FIG. 13B, the inner surface of the film 11B is bonded to the surfaces of the protrusions 42 opposite the surface attached with the base 41 at the partition seal 15.

As shown in FIG. 12, the cut portion 60 is a C-shaped component in a plan view. The opening edge of the C-shaped cut portion 60 is, as shown in FIGS. 12 and 13A, located at positions corresponding to the gaps S between the tearing guide piece 30 and the protrusions 42. The opening edge of the cut portion 60 defines a tearing start position of the film 11A and the tearing guide piece 30. When the unsealing tab 17 is pulled, the film 11A is torn by the tearing guide piece 30 along the longitudinal direction in which the gap S is formed, thereby ensuring linearity of the unsealing process.

Structure of Manufacturing Machine

Figure 14:
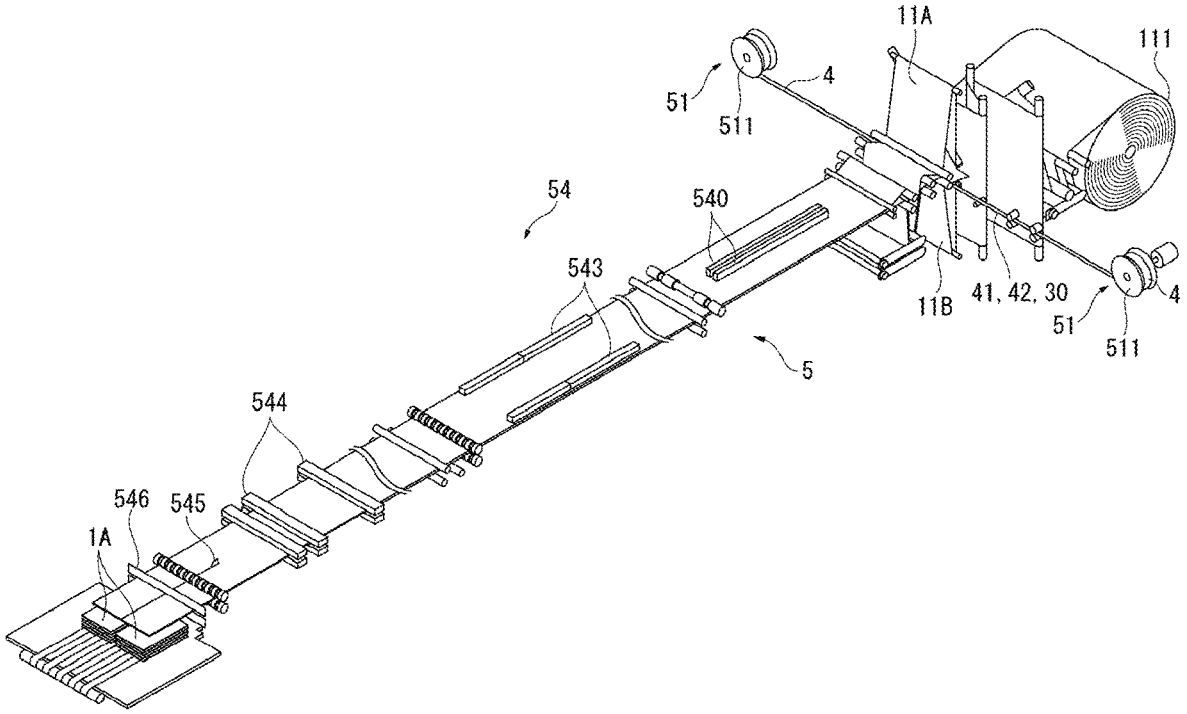
FIG. 14 schematically shows a structure of a manufacturing machine of the bag according to the third exemplary embodiment of the invention.

FIG. 14 shows a manufacturing machine 50 of the bag according to the third exemplary embodiment.

As shown in FIG. 14, the manufacturing machine 50 is configured to manufacture the bag 3 shown in FIG. 11, which has not been provided with the top seal 14. The manufacturing machine 50 has a basic arrangement of a three-sided bag-making machine in the same manner as the manufacturing machine 5.

The manufacturing machine 50 includes: the pair of tape feeders 51 configured to feed the tape 4 integrally including the base 41 and the tearing guide piece 30, and the bag-manufacturing section 54 configured to heat-seal the tape 4 onto the film 11A to form the bag. It should be noted that the manufacturing machine 50 does not include the separator 52 unlike the manufacturing machine 5.

The tape feeders 51 each include the detachably attached tape-winding roller 511 around which the tape 4 is wound and is configured to feed the tape 4. The tape 4 is fed toward the films 11A, 11B from a lateral side of the films 11A, 11B with respect to the feeding direction of the films 11A, 11B and is bent at a predetermined position using a roller and the like in the feeding direction for the films 11A, 11B to be fed.

The bag-manufacturing section 54 includes: a pair of seal bars 540 configured to heat-seal the tape 4 onto the film 11A; a bottom former (not shown) configured to provide the bottom portion to the layered films 11A, 11B; a side former (not shown) configured to provide the lateral portions 10A to the layered films 11A, 11B; a shaping unit 547 (see FIG. 7) configured to provide the opening trigger 61; and a first cut portion 545 and a second cut portion 546 configured to cut the films into the bag.

The bottom former includes the bottom seal bar 543. The side former includes the side seal bar 544 configured to form the side seals 12 and the partition seal 15.

Figure 15:
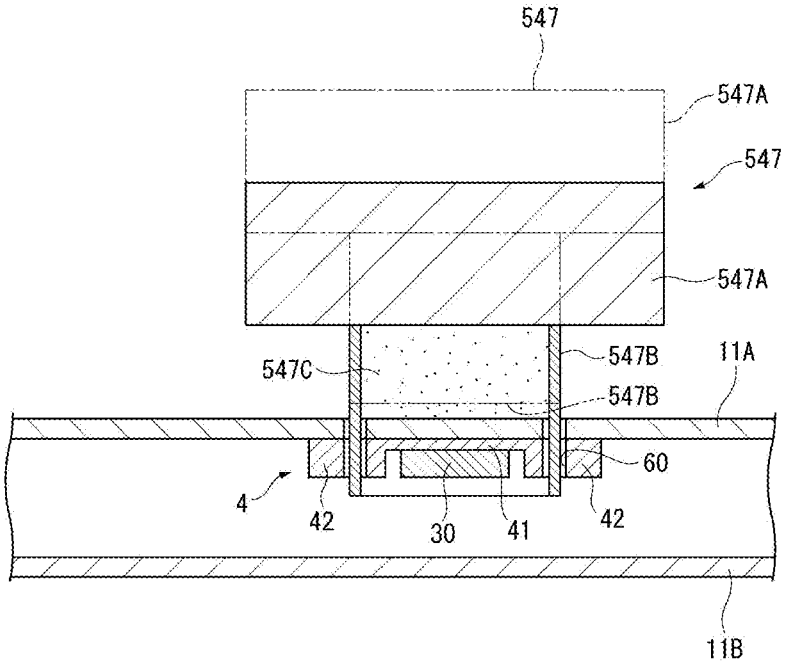
FIG. 15 is a cross sectional view showing the shaping unit being operated.

Detailed arrangement of the shaping unit 547 is shown in FIG. 15. FIG. 15 illustrates how a part of the bag, which is viewed in a direction orthogonal to the longitudinal direction of the tape 4 slightly closer to an edge of one of the side seals 12 than A-A lines in FIG. 12, is processed.

As shown in FIG. 15, the shaping unit 547 includes: the support 547A; the driver (not shown) for advancing and retracting the support 547A between the position indicated by imaginary lines and the position indicated by solid lines; the shaping blade 547B attached to the support 547A; and the rubber 547C for restricting the movement of the shaping blade 547B. The shaping blade 547B is applied from an outer surface of the film 11A to cut the film 11A and the tape 4 to form the C-shaped cut portion 60 and the opening trigger 61.

A filling machine (not shown) for filling the formed bag with the content P is provided downstream of the manufacturing machine 50.

Manufacturing Method of Bag

Next, a process for manufacturing the bag 3, which has not contained the content P, using the manufacturing machine 50 will be described below.

Using the manufacturing machine 50, the tape 4 is fed (tape feeding step), the tape 4 is heat-sealed onto the film 11A (attachment step) and the zipper-tape bag 1A is formed from the film 11A (bag making step).

Initially, the base 41 and the protrusions 42 are integrally formed by extrusion molding or the like and the tearing guide piece 30 is bonded to the base 41 to produce the tape 4. The tape 4 is wound around each of the tape-winding rollers 511.

In the tape feeding step, the tape 4 drawn from each of the tape-winding rollers 511 is delivered into between the layered films 11A, 11B, which are obtained by halving the film fed from the film-winding roller 111.

In the attachment step, the tape 4 is bonded to one of the films 11A using a seal bar 540.

In the bag making step, the film 11B is layered on the film 11A on which the tape 4 is attached in the attachment step. Subsequently, the pair of lateral portions 10A and the bottom portion 10B are provided. The bottom seals 13 are formed using the bottom seal bars 543. The side seals 12 and the partition seal 15 are formed using the side seal bars 544.

The non-bonded region 16, at which the tearing guide piece 30 and the protrusions 42 are not bonded to the film 11B, is formed between one of the side seals 12 and the partition seal 15 during the formation of the side seals 12 and the partition seal 15. In order to form the non-bonded region 16, the seal bar is designed not to bond the part around the portion to be the unsealing tab 17.

Subsequently, the shaping unit 547 is driven to provide the cut portion 60 at the non-bonded region 16 to form the unsealing tab 17. In other words, the shaping unit 547 forms the tab by cutting into the film 11A and a part of the tape 4 including the tearing guide piece 30 without cutting the film 11B.

After the content P is inputted into the thus produced bag, the top seal 14 and the grip 14A are formed. In order to unseal the thus produced bag 3, the unsealing tab 17 is pinched to pull the tearing guide piece 30 from the film 11A. Then, a part of the base 41 and the film 11A are torn apart to form the opening.

Advantage of Third Exemplary Embodiment

The tape 4 and a part of the film 11B facing the film 11A bonded with the base 41 are not bonded at the non-bonded region 16 and the unsealing tab 17 is provided at the non-bonded region 16. Accordingly, the unsealing tab 17 can be easily formed by simply cutting the tape 4 and film 11A attached with the base 41, thereby improving the productivity of the bag 3.

The tearing guide piece 30 is not bonded to the film 11B, which is not to be torn. Accordingly, when the unsealing tab 17 is pinched to pull the tearing guide piece 30, the bag can be expected to be smoothly unsealed.

The protrusions 42 and the tearing guide piece 30 are not in contact with each other and the gaps S are present between the protrusions 42 and the tearing guide piece 30. Accordingly, the resin of the tearing guide piece 30 is kept from being fused with the resin of the base 41 when the tape is manufactured, so that it is expectable that a tearing direction for tearing the base 41 using the tearing guide piece 30 is stabilized.

Modifications

Preferable configurations for practicing the invention and the like have been disclosed above, however, the invention is not limited thereto. In other words, while the invention has been particularly explained and illustrated mainly in relation to a specific exemplary embodiment, a person skilled in the art could make various modifications in terms of materials, quantity or other particulars to the above described exemplary embodiments without deviating from the technical idea or any object of the invention.

Accordingly, the description that limits the materials, the layer structure and the like is only an example to make the invention easily understood, but is not intended to limit the invention, so that the invention includes the description using a name of component without a part of or all of the limitation on the shape and the material etc.

For instance, though the first exemplary embodiment has the short-width male member 21 and long-width female member 22, the arrangement may be reversed.

Specifically, the male member 21 may have a longer width, the female member 22 may have a shorter width and the zipper tape member 2A may integrally include the female member 22 and the tearing guide piece 30. In the above arrangement, the male member 21 may be heat-sealed onto the film 11A after the separated female member 22 and the tearing guide piece 30 are heat-sealed onto the film 11A.

Though the zipper tape member 2A is heat-sealed onto the film 11A after being cut into the male member 21 and the tearing guide piece 30 in the first exemplary embodiment, the zipper tape member 2A may be heat-sealed onto the film 11A without being cut.

Figure 16:
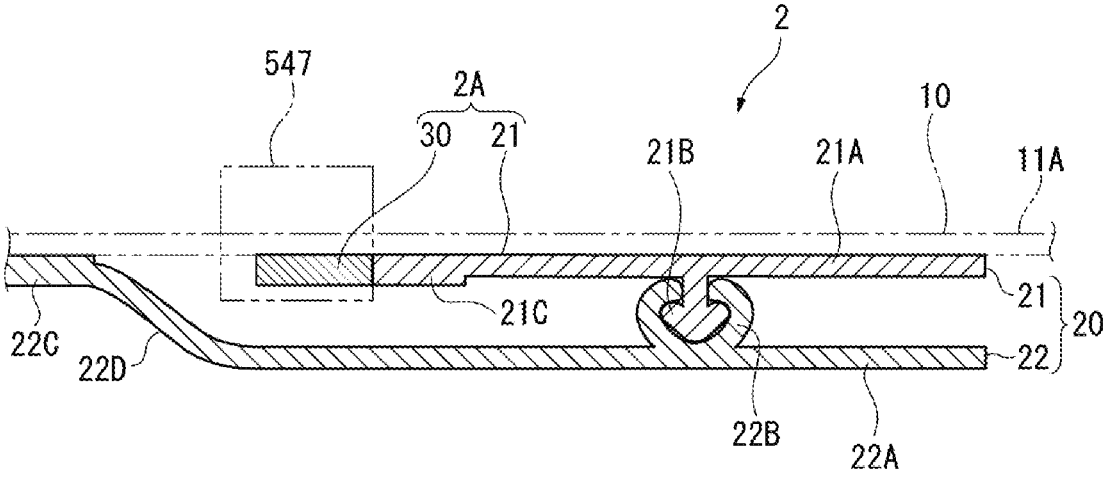
FIG. 16 is a cross sectional view of a relevant part of a tape according to another exemplary embodiment of the invention.

For instance, the zipper tape member 2A may have the tearing guide piece 30 at an end of the male belt-shaped base 21A of the male member 21 in the width direction in a manner capable of interlaminar peeling, as shown in FIG. 16. After the zipper tape member 2A is heat-sealed onto the film 11A, the female member 22 is heat-sealed onto the film 11A. Subsequently, the unsealing tab 17 is formed at the non-bonded region 16 using the shaping unit 547 to manufacture the zipper-tape bag 1A. In order to unseal the bag, the unsealing tab 17 is pinched and pulled to tear the bag body 10 with the interlaminar peeling of the tearing guide piece 30 from the male member 21.

The use of the zipper tape member 2A as shown in FIG. 16 eliminates the need for cutting the zipper tape member 2A, allowing simplification of the structure of the manufacturing machine. In particular, since the tearing guide piece 30 is integrated with the male member 21 in a manner capable of interlaminar peeling, it is not necessary to apply a large force in order to separate the tearing guide piece 30 from the male member 21 when the bag is unsealed, thereby keeping openability of the bag from being impaired.

Figure 17A:
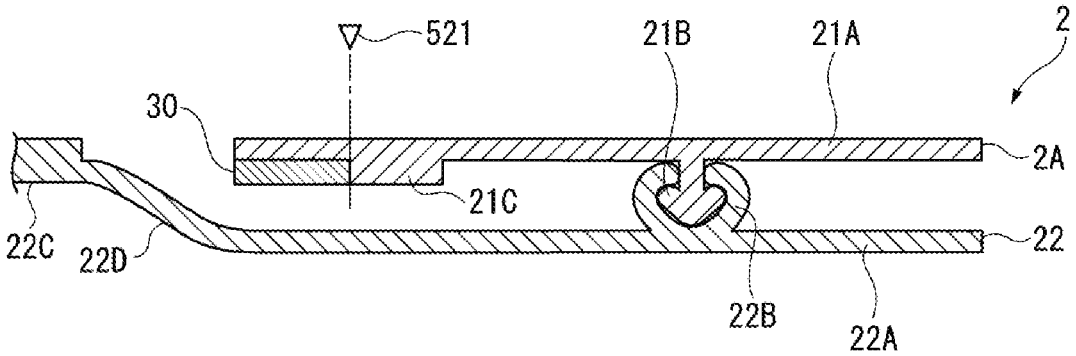
FIG. 17A is a cross sectional view of a relevant part of a tape showing a manufacturing process of a zipper-tape bag according to still another exemplary embodiment of the invention.

Though the end in the width direction of the tearing guide piece 30 is exemplarily integrally bonded to the end of the male member 21 in the width direction in the first exemplary embodiment, the zipper tape member 2A may, for instance, alternatively be configured as shown in FIG. 17A.

Figure 17B:
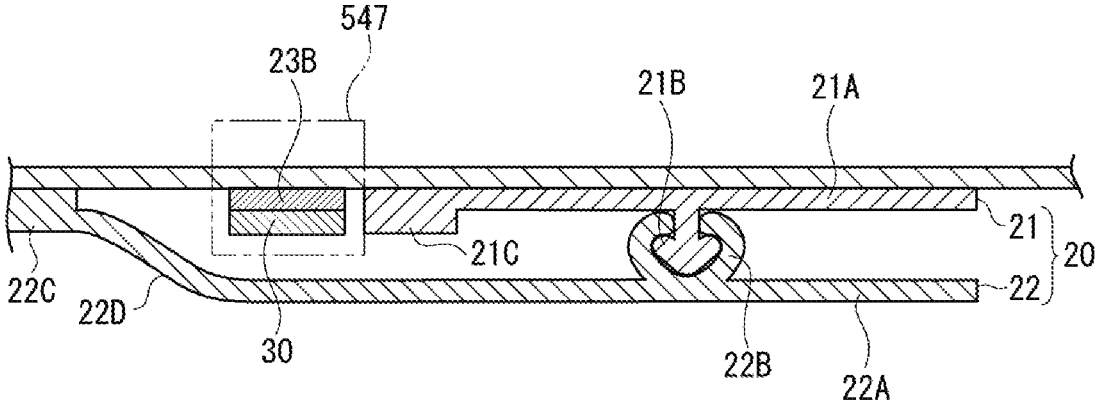
FIG. 17B is a cross sectional view of a relevant part of the zipper-tape bag showing the manufacturing process of the zipper-tape bag according to the still another exemplary embodiment of the invention.

The zipper tape member 2A has the tearing guide piece 30 integrally layered on the male belt-shaped base 21A of the male member 21, as shown in FIG. 17A. The zipper tape member 2A is cut into the tearing guide piece 30 and the male member 21 in the separation step and heat-sealed to the film 11A. It should be noted that the part 23B of the male belt-shaped base 21A is layered on the cut tearing guide piece 30 as shown in FIG. 17B and the tearing guide piece 30 is heat-sealed onto the film 11A through the part 23B of the male belt-shaped base 21A. Subsequently, the unsealing tab 17 may be formed at the non-bonded region 16 to manufacture the zipper-tape bag 1A.

Figure 18:
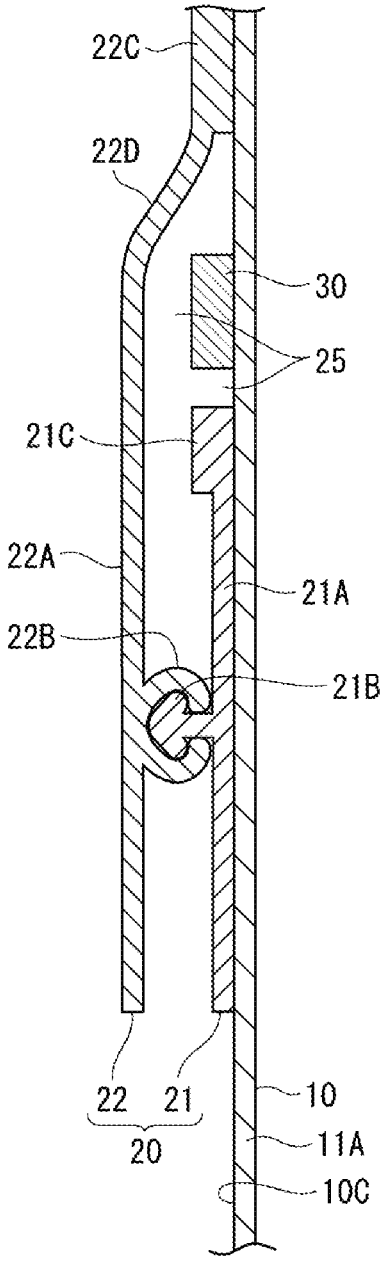
FIG. 18 is a cross sectional view of a relevant part of a zipper-tape bag according to a further exemplary embodiment of the invention.

In the invention, when the zipper tape 20 and the tearing guide piece 30 are heat-sealed onto the film 11A, it is preferable to provide a clearance 25 between the male member 21 and the tearing guide piece 30 and between the tearing guide piece 30 and the female member 22 as shown in FIG. 18.

The exemplary embodiment provided with the clearance 25 as shown in FIG. 18 prevents the tearing guide piece 30 from being integrated with the female member 22 and/or the male member 21 even when a molten resin spreads widthwise in, for instance, heat-sealing the male member 21, the female member 22 and the tearing guide piece 30 onto the film 11A. Thus, it is not necessary to tear the integrated portion at the time of unsealing the bag, so that the bag body 10 can be easily torn and unsealed.

It should be noted that the clearance 25 is required to be wide enough to receive the shaping blade 547B. On the other hand, when the clearance 25 is excessively wide, the film 11A may be freely torn during the shaping process to impair linear cuttability. Accordingly, the dimension of the clearance 25 is set, for instance, in a range from 0.5 mm to 5 mm, preferably in a range from 0.5 mm to 3.0 mm, more preferably at 1.0 mm.

Figure 19:
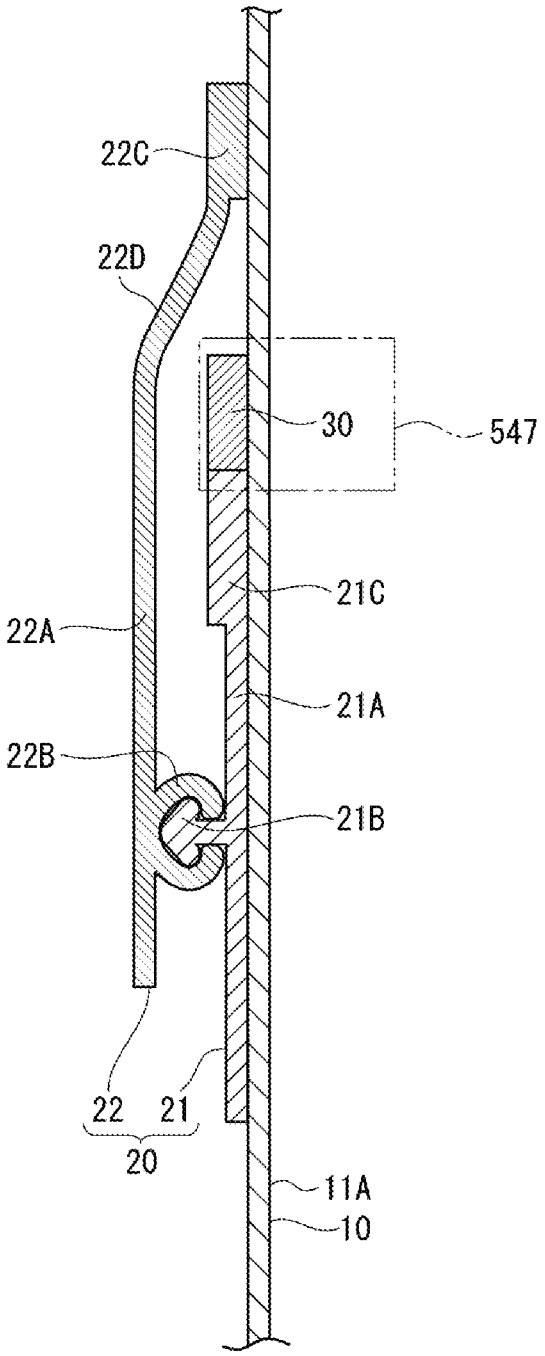
FIG. 19 is a cross sectional view of a relevant part of a zipper-tape bag according to a still further exemplary embodiment of the invention.

Further, as shown in FIG. 19, a first convex portion 21C and a second convex portion 22C may be provided to an end of the male belt-shaped base 21A and the female belt-shaped base 22A in the width direction adjacent to the tearing guide piece 30 in the invention, the first convex portion 21C and the second convex portion 22C respectively having thickness greater than the thickness of the male belt-shaped base 21A and the thickness of the female belt-shaped base 22A.

In the exemplary embodiment shown in FIG. 19, the first convex portion 21C and the second convex portion 22C having greater rigidity are located on both sides of the tearing guide piece 30 in the width direction. Accordingly, when the tearing guide piece 30 is used to tear and unseal the bag body 10, the first convex portion 21C and the second convex portion 22C serve as guides for tearing the bag body 10. Accordingly, the bag body 10 is kept from being torn in an undesired direction, thereby creating a linear opening edge. Further, the first convex portion 21C and the second convex portion 22C are located at the opening edge of the unsealed bag body 10. Accordingly, when the opening edges are widely separated to disengage the male portion 21B and the female portion 22B, the first convex portion 21C and the second convex portion 22C form step-shaped portions to serve as slip stoppers, thereby facilitating the opening process.

In particular, it is preferable that the thicknesses of the first convex portion 21C and the second convex portion 22C are made equal to the thickness of the tearing guide piece 30. According to the above arrangement, the heights of the first convex portion 21C and the second convex portion 22C pressed against the films at the time of the heat-sealing can be equalized, so that the heat-sealing process can be performed in a single step using a seal bar of a simple shape having a planar pressing surface, thereby easily simplifying the manufacturing machine and improving the production efficiency.

Figure 20A:
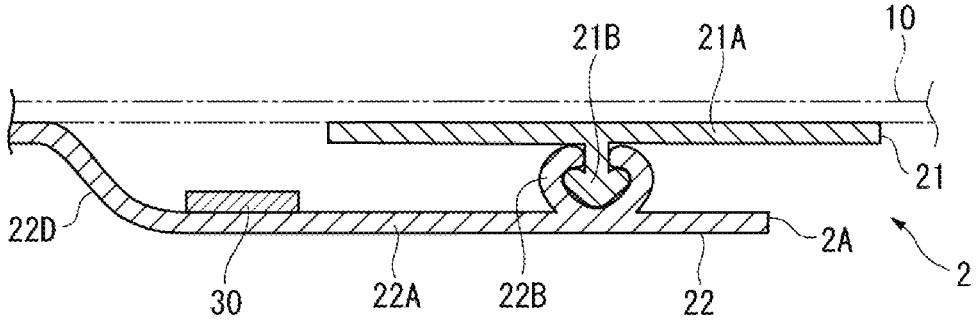
FIG. 20A is a cross sectional view of a relevant part of a tape showing a manufacturing process of a zipper-tape bag according to a still further exemplary embodiment of the invention.

Further, the zipper tape member 2A is not necessarily provided by integrating the short-width male member 21 with the tearing guide piece 30, but may be provided by integrating the long-width female member 22 with the tearing guide piece 30, for instance, as shown in FIG. 20A.

The zipper tape member 2A of an exemplary embodiment shown in FIG. 20A includes the tearing guide piece 30 laminated in a manner capable of interlaminar peeling on a surface of the female belt-shaped base 22A of the female member 22 on which the female portion 22B is provided. The tearing guide piece 30 is provided at a position where a distance from a base end of the female portion 22B of the female member 22 to an end of the tearing guide piece 30 in the width direction is longer than a distance from a base end of the male portion 21B of the male member 21 to an end of the male belt-shaped base 21A in the width direction.

The tearing guide piece 30 is peeled off from the zipper tape member 2A by interlaminar peeling and the separated tearing guide piece 30 and the male member 21 are heat-sealed onto the film 11A. Subsequently, the separated female member 22 is heat-sealed onto the film 11A. Subsequently, the unsealing tab 17 may be formed at the non-bonded region 16 to manufacture the zipper-tape bag 1A.

Figure 20B:
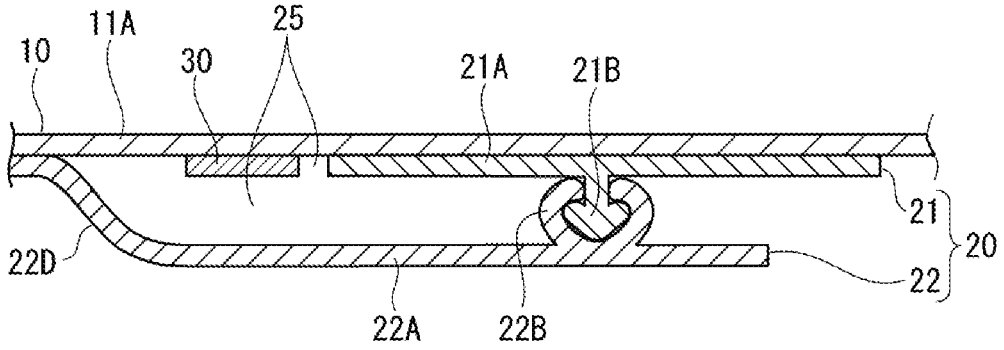
FIG. 20B is a cross sectional view of a relevant part of the zipper-tape bag showing the manufacturing process of the zipper-tape bag according to the still further exemplary embodiment of the invention.

Alternatively, the clearance 25 may be provided between the male belt-shaped base 21A and the tearing guide piece 30 as shown in FIG. 20B.

Though the zipper tape 20 includes the single male portion 21B and the single female portion 22B in the exemplary embodiments, a plurality of the male portions 21B and the female portions 22B may alternatively be provided.

Figure 21:
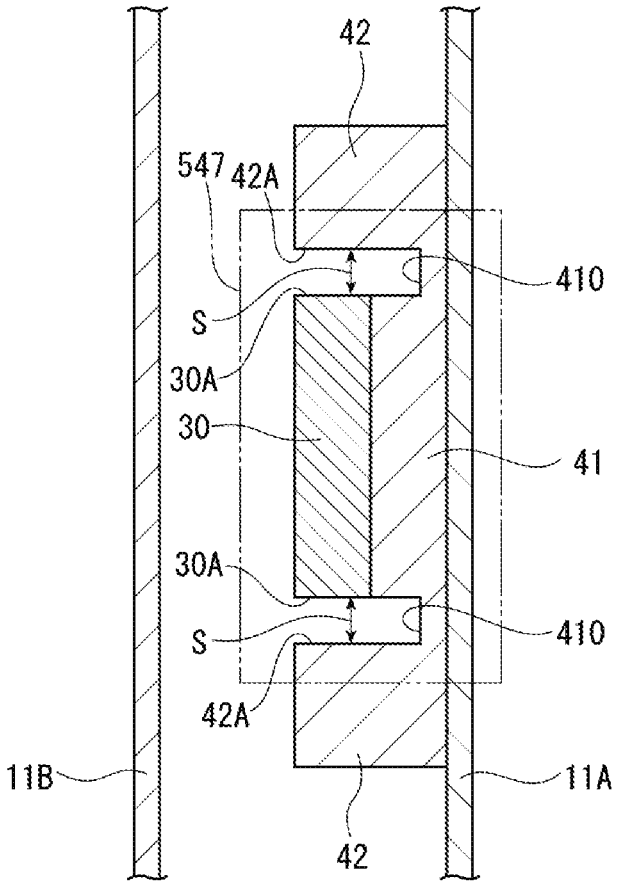
FIG. 21 is a cross sectional view of a relevant part of a bag according to a still further exemplary embodiment of the invention.

Though the protrusions 42 are formed on the flat base 41 in the third exemplary embodiment, the base 41 may have a thin portion between each of the protrusions 42 and the tearing guide piece 30 as shown in FIG. 21. Specifically, the gap S is provided between each of the protrusions 42 and the tearing guide piece 30 and cuts 410 each continuous with the gap S is formed in the base 41.

Though the two protrusions 42 are disposed on both ends in the width direction of the base 41 in the third exemplary embodiment, only a single protrusion 42 may be provided. Further, though the base 41 is a single component, the base 41 may be divided into a plurality of components in the width direction of the base 41.

The invention is applicable to a gusset bag having the lateral portions 10A and the bottom portion 10B and may also be applicable to a gusset bag having only the bottom portion 10B and a gusset bag without the bottom portion 10B, and further to a bag having none of the lateral portion 10A and the bottom portion 10B.

The process for manufacturing the zipper-tape bag 1 is not necessarily the three-sided bag-making process, but may alternatively be a four-sided bag-making process, a pillow-bag making process, rotary-drum bag-making process or the like.

Though the zipper tape member 2A cut out from the tape 2 is heat-sealed onto the film 11A in some of the exemplary embodiments, the zipper tape member 2A and the tape 2 may be heat-sealed onto the film 11A without being cut.

The unsealing tab 17 may be formed at any timing as long as the film 11A can be penetrated. For instance, the unsealing tab 17 may be formed after the tearing guide piece 30 and the male belt-shaped base 21A are heat-sealed on the film 11A and before the female belt-shaped base 22A is heat-sealed on the film 11A. The unsealing tab 17 may be formed at any desired timing depending on the bag-making method.

It should be noted that the thickness of the long-width female belt-shaped base 22A is preferably increased to some degree (e.g. 100 μm or more) in order to keep the shaping blade from penetrating through the long-width female belt-shaped base 22A even when the cutting depth of the shaping blade for forming the unsealing tab 17 has an error.

The tearing guide piece 30 is not necessarily a belt-shaped component but may be in a form of a string or the like as long as the tearing guide piece 30 is capable of tearing the film 11A.

The invention claimed is:

1. A manufacturing method of a bag comprising: a bag body comprising a folded single film or at least two sheets of film layered on each other; a zipper tape attached to one of opposing inner surfaces of the bag body; and a longitudinal separation strip configured to form an opening in the bag body, wherein the zipper tape comprises a female member comprising a female belt-shaped base and a female portion provided on the female belt-shaped base, a male member comprising a male belt-shaped base and a male portion provided on the male belt-shaped base and engageable with the female portion, and an extension on one of the female belt-shaped base and the male belt-shaped base, the extension being defined, when the female portion and the male portion are engaged, by a part of a longer-width one of the female belt-shaped base and the male belt-shaped base lengthened toward an end in a width direction with respect to a shorter-width one of the female belt-shaped base and the male belt-shaped base, and the separation strip is interposed between the female belt-shaped base and the male belt-shaped base or between the longer-width one of the female belt-shaped base and the male belt-shaped base and the film on which the shorter-width one of the female belt-shaped base and the male belt-shaped base is attached, the separation strip being a longitudinal component configured to cut the film attached with the shorter-width one of the female belt-shaped base and the male belt-shaped base to form the opening in the bag body, the separation strip being disposed at a position facing the extension, the method comprising:

attaching the separation strip and the shorter-width one of the female belt-shaped base and the male belt-shaped base on the film separately or attaching the separation strip having been integrated with the shorter-width one of the female belt-shaped base and the male belt-shaped base on the film;

attaching the longer-width one of the female belt-shaped base and the male belt-shaped base on the film attached with the separation strip and the shorter-width one of the female belt-shaped base and the male belt-shaped base in a manner capable for the female portion and the male portion to be engaged; and cutting the separation strip and the film attached with the shorter-width one of the female belt-shaped base and the male belt-shaped base to form a tab without cutting the longer-width one of the female belt-shaped base and the male belt-shaped base and the film facing a surface of the longer-width one of the female belt-shaped base and the male belt-shaped base opposite a surface provided with the female portion or the male portion of the longer-width one of the female belt-shaped base and the male belt-shaped base while a facing portion defined at a part of the longer-width one of the female belt-shaped base and the male belt-shaped base, which faces the separation strip, is not bonded with the separation strip, wherein in order to form the tab, a mechanism comprising a blade and a movement restrictor configured to restrict a movement of the blade is used to cut the film from an outer surface of the film with the blade and, when the blade reaches a predetermined depth, the movement of the blade is restricted by the movement restrictor, and the movement restrictor is located within the blade.

2. The manufacturing method of a bag according to claim 1, wherein a first convex portion thicker than a thickness of the shorter-width one of the female belt-shaped base and the male belt-shaped base is provided to the shorter-width one of the female belt-shaped base and the male belt-shaped base at a side adjacent to the separation strip at the end in the width direction, and a second convex portion thicker than the longer-width one of the thickness of the female belt-shaped base and the male belt-shaped base is provided to the longer-width one of the female belt-shaped base and the male belt-shaped base at a side adjacent to the separation strip at an end in the width direction.

3. The manufacturing method of a bag according to claim 2, wherein a clearance is provided between the separation strip and the first convex portion and between the separation strip and the second convex portion.

4. The manufacturing method of a bag according to claim 1, wherein the separation strip is attached to the film in a form of a component independent of the zipper tape.

* * * * *